US011564474B2

(12) United States Patent
Chan et al.

(10) Patent No.: US 11,564,474 B2
(45) Date of Patent: Jan. 31, 2023

(54) COSMETICS STORAGE AND ORGANIZATIONAL SYSTEM

(71) Applicant: For Youth, LLC, Newark, DE (US)

(72) Inventors: Fiona Co Chan, San Francisco, CA (US); Christopher Kin-To Chan, Hong Kong (HK)

(73) Assignee: FOR YOUTH, INC., San Francisco, CA (US)

( * ) Notice: Subject to any disclaimer, the term of this patent is extended or adjusted under 35 U.S.C. 154(b) by 0 days.

(21) Appl. No.: 17/200,711

(22) Filed: Mar. 12, 2021

(65) Prior Publication Data

US 2022/0071374 A1 Mar. 10, 2022

Related U.S. Application Data

(60) Provisional application No. 63/075,587, filed on Sep. 8, 2020.

(51) Int. Cl.
*A45D 40/24* (2006.01)
*A45D 40/00* (2006.01)

(52) U.S. Cl.
CPC ..... *A45D 40/24* (2013.01); *A45D 2040/0006* (2013.01); *A45D 2200/05* (2013.01)

(58) Field of Classification Search
CPC ..... B65D 2313/04; A45D 2200/25; A45D 2040/0012; A45D 34/06
See application file for complete search history.

(56) References Cited

U.S. PATENT DOCUMENTS

| | | | | |
|---|---|---|---|---|
| 5,135,012 | A * | 8/1992 | Kamen | A45C 13/02 132/294 |
| 6,035,865 | A * | 3/2000 | Krieger | A45D 34/06 132/293 |
| 6,796,431 | B1 * | 9/2004 | Goldring | A45D 33/006 132/297 |
| 9,743,742 | B2 * | 8/2017 | Brogoitti | A45D 33/26 |
| 10,064,474 | B2 * | 9/2018 | Ziemann | A45D 40/06 |
| 10,602,818 | B1 | 3/2020 | Kerr | |
| 2011/0061675 | A1 * | 3/2011 | McKinley | A45D 33/24 132/296 |
| 2011/0103872 | A1 * | 5/2011 | Choi | A45D 40/24 401/34 |

(Continued)

FOREIGN PATENT DOCUMENTS

| | | | |
|---|---|---|---|
| CN | 207477142 | U | 6/2018 |
| KR | 101849179 | B1 | 4/2018 |
| WO | 2005023049 | A1 | 3/2005 |

OTHER PUBLICATIONS

International Search Report and Written Opinion for PCT/US2021/022240, dated Jun. 25, 2021.

*Primary Examiner* — Nicholas D Lucchesi
*Assistant Examiner* — Jennifer Gill
(74) *Attorney, Agent, or Firm* — Concept IP LLP; Pejman Yedidsion

(57) ABSTRACT

Systems, devices, and methods including a base pan, the base pan comprising one or more male indentations; and a cosmetic container, the cosmetic container including a female indentation, where the female indentation of the cosmetic container may be configured to receive a male indentation of the one or more male indentations such that the cosmetic container is detachably attached to the base pan.

6 Claims, 23 Drawing Sheets

(56) References Cited

U.S. PATENT DOCUMENTS

| | | | | |
|---|---|---|---|---|
| 2012/0294666 | A1* | 11/2012 | Jang | A45D 34/00 401/126 |
| 2014/0299151 | A1* | 10/2014 | Stroud | A45D 33/20 132/315 |
| 2015/0182003 | A1* | 7/2015 | Neuner | B65D 51/32 401/122 |
| 2015/0250291 | A1* | 9/2015 | Irving | A45D 40/06 132/286 |
| 2016/0081453 | A1* | 3/2016 | Wightman | A45D 42/02 132/200 |
| 2018/0263361 | A1* | 9/2018 | Langdon | A45D 40/24 |
| 2019/0059557 | A1 | 2/2019 | Kehoe et al. | |

* cited by examiner

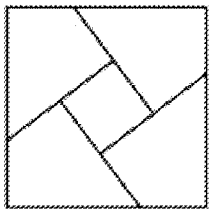
FIG. 21A
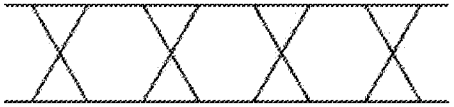
FIG. 21B
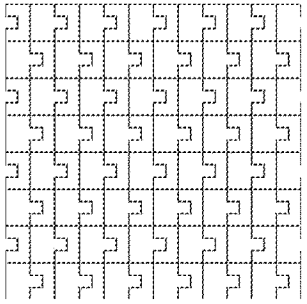
FIG. 21C
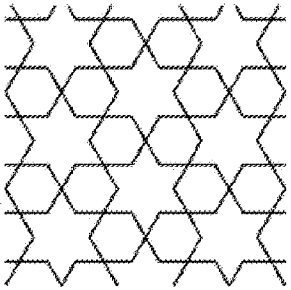
FIG. 21D
FIG. 21E
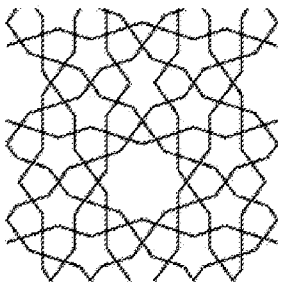
FIG. 21F
FIG. 21G
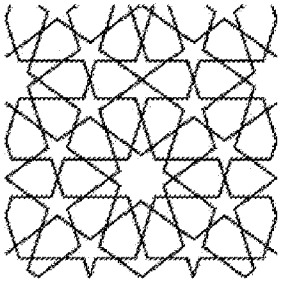
FIG. 21H

COSMETICS STORAGE AND ORGANIZATIONAL SYSTEM

CROSS-REFERENCE TO RELATED APPLICATIONS

This application claims priority to and the benefit of U.S. Provisional Patent Application No. 63/075,587, filed Sep. 8, 2020, the contents of which are hereby incorporated by reference herein for all purposes.

TECHNICAL FIELD

Embodiments relate generally to storage containers, and more particularly to cosmetic storage systems.

BACKGROUND

Cosmetics are health and beauty products used for the skin and body. Cosmetic items are often sold in a variety of sizes and shapes such that it is difficult to organize these items. Makeup organizers used to hold cosmetics generally consist of one or more large trays for placing loose cosmetics. These makeup organizers make it difficult to easily find needed cosmetics and/or do not fit cosmetic containers having unique shapes and/or sizes.

SUMMARY

A system embodiment may include: a base pan comprising one or more male indentations and one or more magnets; a cosmetic container comprising a female indentation, where the female indentation of the cosmetic container may be configured to receive a male indentation of the one or more male indentations such that the cosmetic container may be configured to be detachably attached to the base pan, where the cosmetic container further comprises: a bottle, where the female indentation may be disposed on a bottom of the bottle; and at least one magnet disposed in the female indentation, where the at least one magnet in the female indentation may be configured to attract the one or more magnets in the base pan to secure the cosmetic container to the base pan.

In additional system embodiments, the base pan further comprises: a base. In additional system embodiments, the base pan further comprises: a cover comprising one or more male indentations, where the cover fits over the base. In additional system embodiments, the one or more magnets may be disposed between the cover and the base.

In additional system embodiments, the cosmetic container further comprises: a cap, where the cap may be detachably attached to the bottle. In additional system embodiments, the cosmetic container further comprises: a top cap attached to the cap such that the top cap forms a male indentation. In additional system embodiments, the cosmetic container further comprises: a magnet disposed between the cap and the top cap. In additional system embodiments, the cosmetic container further comprises: a collar attached to a top portion of the bottle, where the top portion of the bottle may be disposed distal from the female indentation. In additional system embodiments, the cosmetic container further comprises: a plug disposed in an opening of the collar. In additional system embodiments, the cosmetic container further comprises: an inner cap secured to the collar; and an applicator connected to the inner cap.

Another system embodiment may include: at least one large base pan, where each large base pan comprises one or more male indentations on a top surface; at least one first cosmetic container, where each first cosmetic container comprises a female indentation on a bottom surface configured to receive a male indentation of the one or more male indentations of the at least one large base pan, and where each first cosmetic container comprises a male indentation on a top surface; at least one medium base pan, where each medium base pan comprises a female indentation on a bottom surface configured to receive a male indentation of at least one of: the one or more male indentations of the at least one large base pan and the male indentation of the at least one first cosmetic container, and where each medium base pan comprises one or more male indentations on a top surface; and at least one second cosmetic container, where each second cosmetic container comprises a female indentation on a bottom surface configured to receive a male indentation of the one or more male indentations of the at least one medium base pan, and where each second cosmetic container comprises a male indentation on a top surface.

Additional system embodiments may include: at least one small base pan, where each small base pan comprises a female indentation on a bottom surface configured to receive a male indentation of at least one of: the one or more male indentations of the at least one medium base pan and the male indentation of the at least one second cosmetic container, and where each small base pan comprises one or more male indentations on a top surface. Additional system embodiments may include: at least one third cosmetic container, where each third cosmetic container comprises a male indentation on a top surface, and where each third cosmetic container comprises a female indentation on a bottom surface configured to receive a male indentation of at least one of: the one or more male indentations of the at least one small base pan the male indentation of the at least one third cosmetic container.

In additional system embodiments, each large base pan comprises: a base; a cover comprising one or more male indentations, where the cover fits over the base; and one or more magnets disposed between the cover and the base. In additional system embodiments, each medium base pan comprises: a base; a cover comprising one or more male indentations, where the cover fits over the base; and one or more magnets disposed between the cover and the base.

In additional system embodiments, each second cosmetic container comprises: a bottle, where the female indentation may be disposed on a bottom of the bottle; and at least one magnet disposed in the female indentation, where the at least one magnet in the female indentation may be configured to attract one or more magnets in the medium base pan to secure the second cosmetic container to the medium base pan.

Another system embodiment may include: two or more cosmetic containers, where each cosmetic container comprises: one or more side magnets, where each cosmetic container of the two or more cosmetic containers may be configured to detachably attach to another cosmetic container of the two or more cosmetic containers via attraction of the one or more side magnets; a bottle, where a female indentation may be disposed on a bottom of the bottle; at least one magnet disposed in the female indentation; a cap, where the cap may be detachably attached to the bottle; a top cap attached to the cap such that the top cap forms a male indentation; and at least one magnet disposed between the cap and the top cap.

Additional system embodiments may include: two or more base pans, where each base pan comprises: one or more side magnets, where each base of the two or more base pans may be configured to detachably attach to another base pan of the two or more base pans via attraction of the one or more side magnets. In additional system embodiments, each base pan further comprises: a base; a cover comprising one or more male indentations, where the cover fits over the base; and one or more magnets disposed between the cover and the base. In additional system embodiments, each cosmetic container may be configured to detachably attach to each base pan via the female indentation of each cosmetic container and the one or more male indentation of each cover.

BRIEF DESCRIPTION OF THE DRAWINGS

The components in the figures are not necessarily to scale, emphasis instead being placed upon illustrating the principals of the invention. Like reference numerals designate corresponding parts throughout the different views. Embodiments are illustrated by way of example and not limitation in the figures of the accompanying drawings, in which:

FIGS. 21A-21H depict alternate base pans connected to one another by side magnets.

DETAILED DESCRIPTION

The present system allows for a modular cosmetic system for storing cosmetic items and tools in an organized fashion. More particularly, the disclosed system relates to an improved device and system that is uniquely configured to interchangeably fit modular boxes. This disclosed construction advantageously allows for the creation of a unique adjustable box and/or tray system for organizing and storing makeup and the like.

The disclosed system is a modular system for storing small objects such as cosmetic items in an organized fashion. In one embodiment, the cosmetic system is uniquely configured. Cosmetic cases are designed with the cosmetic storage system in mind. There is no predefined shape, which allows for unique modular shapes. A storage system is provided that may be used at home and while traveling because component parts may be rearranged. The use of strategically placed magnets allows storage to be used horizontally, such as on top of a shelf or tabletop, as well as vertically, such as hung on a wall. The use of strategically placed magnets may also prevent items from getting disorganized in transport. The disclosed cosmetic organization and storage system may include several parts, such as base pans, cosmetic containers, and empty containers.

Cosmetic containers and cosmetic storage and/or organization systems may be designed independently of each other. The disclosed modular organizational system that utilizes male-female attachments and magnetic components allow the user to easily transport makeup from at-home storage and/or in-store display to their travel bag without ruining the organization. The use of different shapes of base pans, as well as base pans that stack on top of each other, allows users to create unique and modular arrangements for organization. The base pans may be used horizontally, such as on top of a table or shelf, or vertically, such as wall-mounted, in embodiments configured to utilize magnets and the male-female shape.

Different cosmetic containers have the ability to attach to each other for the same type of makeup, e.g., two lipsticks may attach to each other, as well as for different types of makeup, e.g., a lip gloss may attach to a mascara, which allows for the organization of makeup to fit a user's unique space instead of being prescriptive on size of cosmetic container storage from a rigid box.

Figure 1:
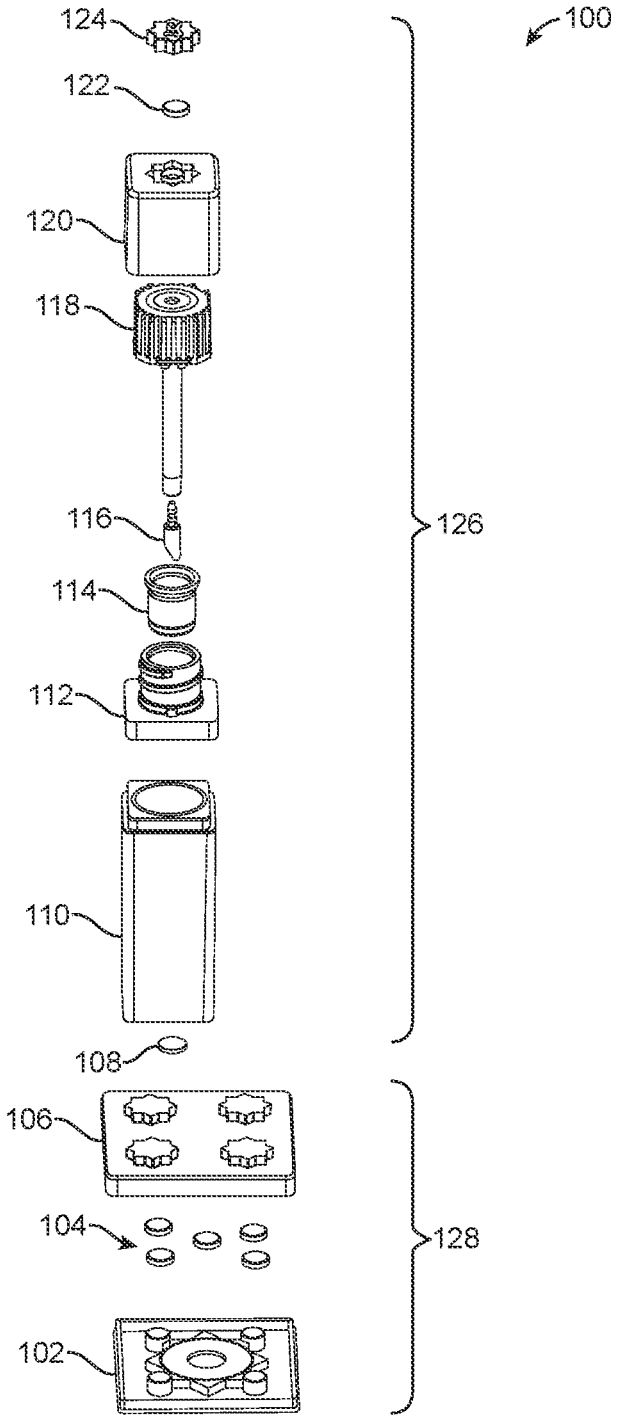
FIG. 1 depicts an exploded perspective view of a cosmetic storage system.

FIG. 1 depicts an exploded perspective view of an embodiment of a cosmetic storage system 100. The system may include a base 102. The base 102 may have one or more indentations configured to receive one or more magnets 104. A cover 106 may be placed over the base 102. In some embodiments, the cover 106 may be a hard plastic. In other embodiments, the cover 106 may be a soft plastic. Other material types are possible and contemplated.

A bottle 110 may have at least one magnet 108 disposed in a bottom portion of the bottle 110. The magnet 108 of the container 110 may attract the at least one magnet 104 of the base 102 to secure the bottle 110 to the cover 106 and base 102 when the bottle 110 is detachably attached to the cover 106 and base 102.

A collar 112 may be attached to a top portion of the bottle 110. The top portion of the bottle 110 may be disposed distal from the bottom portion of the bottle 110. A plug 114 may be disposed in an opening of the collar 112.

An inner cap 118 may be connected to an applicator 116. The applicator 116 may vary based on the type of cosmetics being stored. For example, an applicator for lip gloss applicator may vary from an applicator for mascara. Various makeup applicators 116 are possible and contemplated. The inner cap 118 may be secured to the collar 112 when not in use, such as by screw threads, friction fit, or the like.

A cap 120 may be placed over the inner cap 118. The cap 120 may be attached to the collar 112 and/or bottle 110 to secure the cap 120 to the collar 112 and/or bottle 110. A magnet 122 may be disposed in a portion of the cap 120. A top cap 124 may be disposed over the cap 120 in some embodiments. In some embodiments, the top cap 124 may secure the magnet 122 within the cap 120. In some embodiments, the cap 120 may be a single piece. In some embodiments, the cap 120 may be made from resin and/or plastic. In some embodiments, the magnet 122 may be placed under the cap 120 such that the magnet 122 is between the cap 120 and the inner cap 118.

The system may include one or more indentations in the cap 120 and/or bottle 110. The bottle 110 may contain a female indentation configured to receive the male indentation of the cover 106. The female indentation of the bottle 110 may be a corresponding shape to the shape of the male indentation of the cover 106 or a shape configured to receive the male indentation of the cover 106, such as seen in FIG. 8A. In some embodiments, the top cap 124 may be used to convert the cap from a female indentation to a male indentation where such a female indentation may be connected to the male indentation of the cap 120 and top cap 124. In some embodiments, the cap 120 may not include a magnet 122 disposed between the cap 120 and the top cap 124.

While male and female indentations are shown, it is possible and contemplated that the arrangement of male and female indentations may be reversed in some embodiments. For example, each base pan may include one or more female indentations configured to receive one or more male indentations of one or more cosmetic containers or smaller base pans.

In some embodiments, the tops of each cosmetic container may have female indentations, male indentations, or flat tops. In some embodiments, each cosmetic container may have curved edges with magnets placed to connect the cosmetic containers to a corresponding base (See FIG. 15B). The configuration of each cosmetic container may be varied depending on the use and desired interaction with the rest of the system.

In some embodiments, none of the components may have male or female indentations, and the tops and bottoms of each component may be flat. For example, the base pans and cosmetic containers may be detachably attached only by magnets. There may be some containers that do not have a male shape at the top cap or a female shape at the bottom and instead have a flat shape. In this embodiment, the containers may still be configured to stack on top of each other with strategically placed magnets. They may also attach to the smaller base pans to attach to the bigger base pan system. There may be some containers that do not have a male shape that sticks up but has a female indented shape at the bottom. In this embodiment, the magnets would be placed around the edge of the container so that they could still be strategically stacked on top of each other.

In some embodiments, each cosmetic container may be an outer case such that each cosmetic container may be refillable. In some embodiments, the cap 120 may have a different shape, length, and/or width as compared to the bottle 110 of the container. In some embodiments, the bottle 110 and/or cap 120 may include one or more ridges.

In some embodiments, the base 102 may be configured without magnets. The base pan 128 may be made from a ferromagnetic material such as iron, nickel, cobalt, tin, or the like. The magnet 108 in the cosmetic container 126 may be attracted to the ferromagnetic material of the base pan 128. In other embodiments, the cosmetic container 126 may not include a magnet. A portion of the bottle 110 distal from the cap 120 may include and/or be made from a ferromagnetic material such as iron, nickel, cobalt, tin, or the like. The magnet 104 in the base pan 128 may be attracted to the ferromagnetic material of the container 110.

A cosmetic container 126 may include the magnet 108, bottle 110, collar 112, plug 114, applicator 116, inner cap 118, cap 120, magnet 122, and top cap 124. A base pan 128 may include a base 102, one or more magnets 104, and cover 106. The base pan 128 may be any size, such as a large base pan, medium base pan, or small base pan, as described below.

Figure 2A:
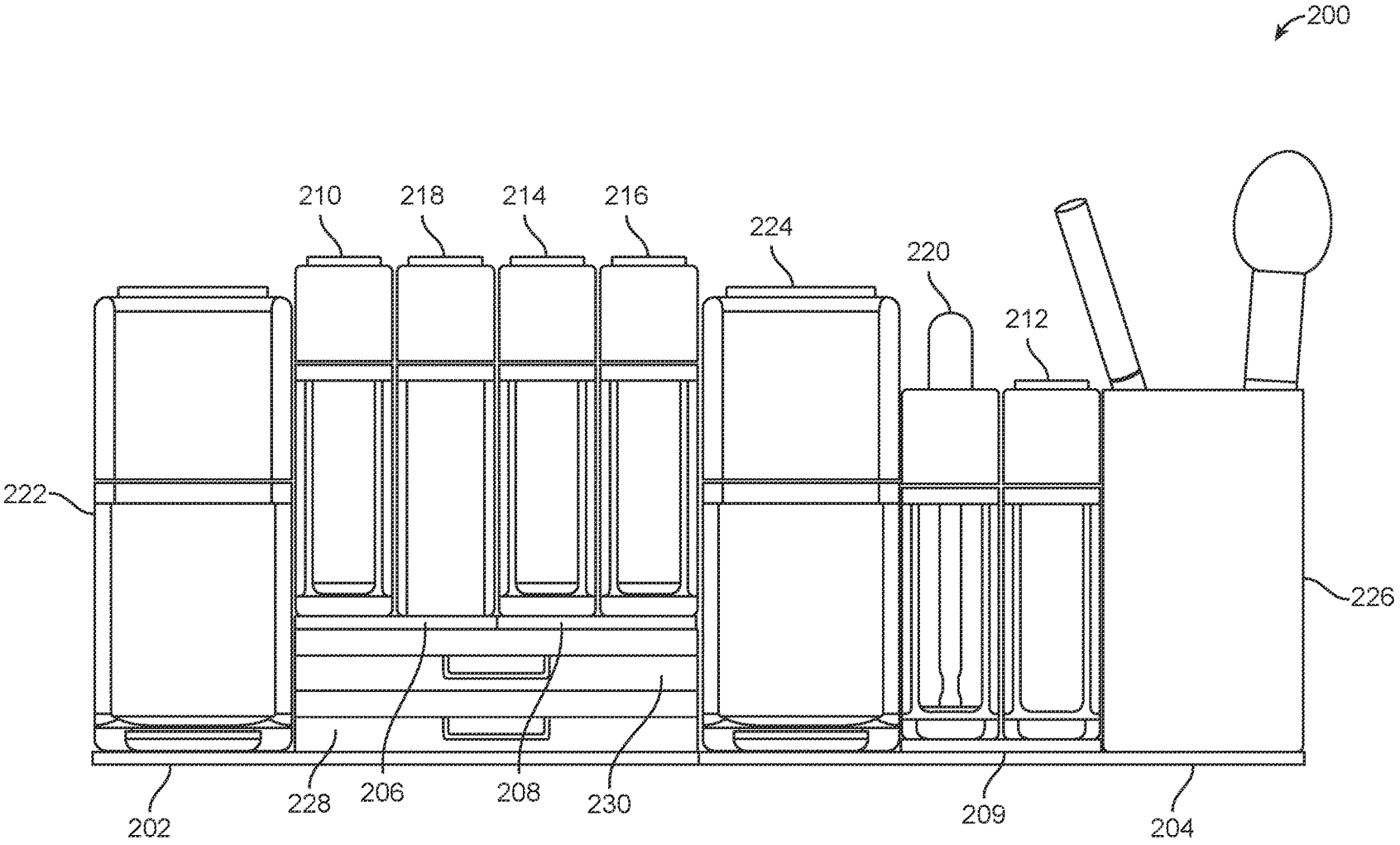
FIG. 2A depicts a front view of another embodiment of a cosmetic storage system having additional components.
Figure 4A:
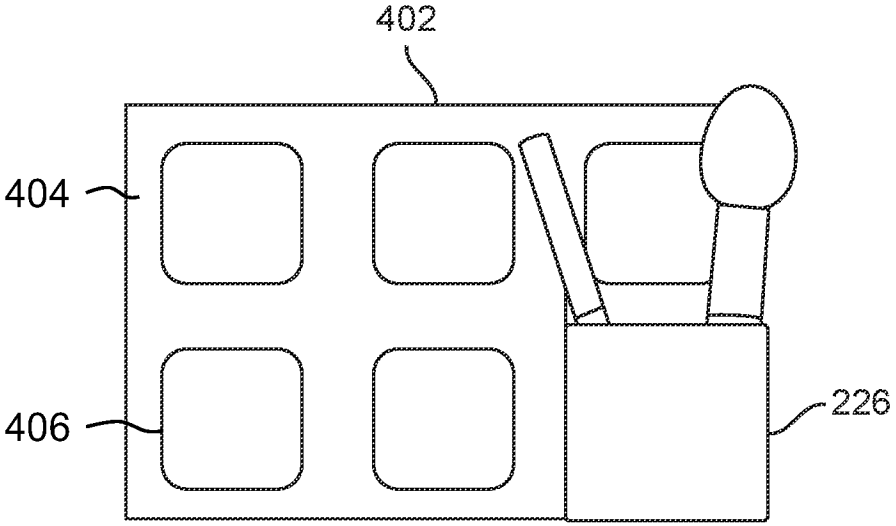
FIG. 4A depicts a container attached to a wall-mounted large base pan.

FIG. 2A depicts a front view of another embodiment of a cosmetic storage system 200 having additional components. The system 200 may include a number of base pans for connecting containers, such as a first large base pan 202, a second large base pan 204, a first medium base pan 206, and a second medium base pan 208, and a third medium base pan 209. The system 200 may also include a number of containers for holding cosmetics, such as a first cosmetic container for a liquid lip product 210 and a second cosmetic container for a liquid lip product 212. Large base pans 202, 204 may use strategically placed magnets and a female/male shape. Large base pans 202, 204 may sit at the bottom and may be used as a display on a tabletop or hung vertically wall-mounted, such as shown in FIG. 4A.

Large base pans 202, 204 may be made up of two pieces of hard material such as plastic. Magnets may be encased in the middle of each of these two pieces of hard material. One embodiment may have the top panel have a male shape that protrudes out. The top panel may have edges that go over the bottom panel. The inside of the bottom panel may have encasings to fit the size of the magnets. For each protruding male shape, there may be 4 corresponding magnets at the 4 corners of the shape. The north side of each magnet may face the top panel. The magnetic polarity and placement of the magnets are such that they correspond with the magnetic polarity and placement of corresponding containers, cosmetic containers, and additional medium base pans 206, 208, 209 that may be stacked on top of the large base pans 202, 204.

The first cosmetic container for a liquid lip product 210 may attach to the first medium base pan 206, such as by magnets and/or interlocking protrusions as shown in FIG. 1. The second cosmetic container for a liquid lip product 212 may attach to the third medium base pan 209, such as by magnets and/or interlocking protrusions as shown in FIG. 1. Medium base pans 206, 208, 209 may go on top of large base pans 202, 204: these attach on top of the large base pans 202, 204, and allows for smaller cosmetic containers to sit on top of it, such as a lip gloss or a lipstick.

Figure 2B:
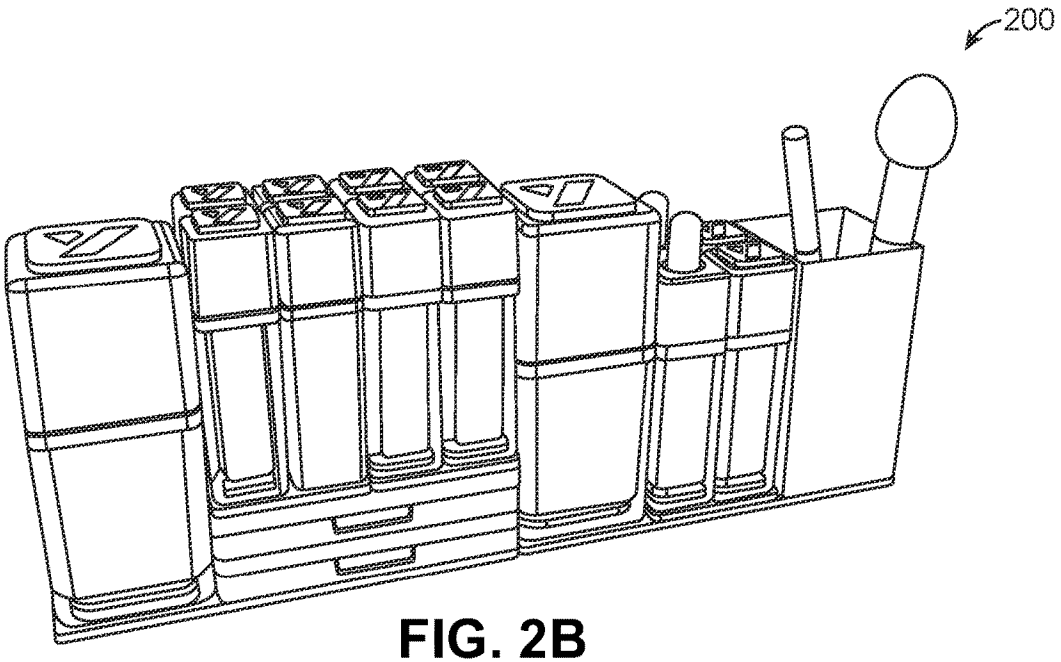
FIG. 2B depicts a perspective view of the cosmetic storage system of FIG. 2A.
Figure 2C:
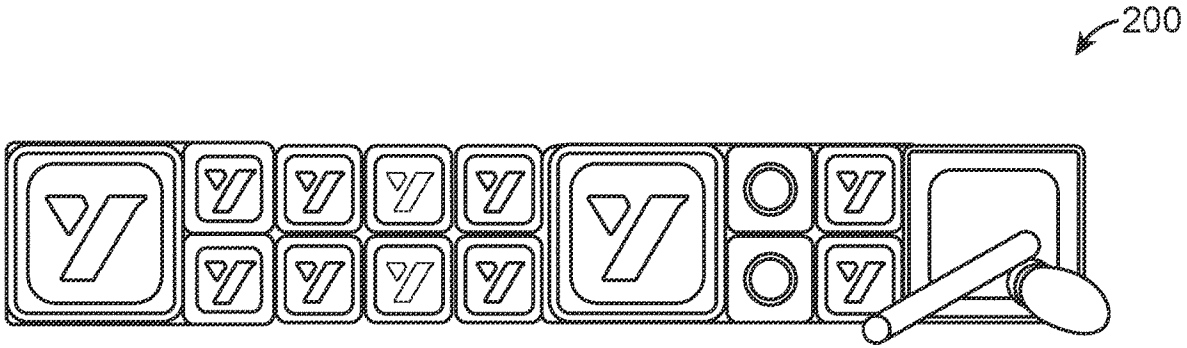
FIG. 2C depicts a top view of the cosmetic storage system of FIG. 2A.
Figure 3:
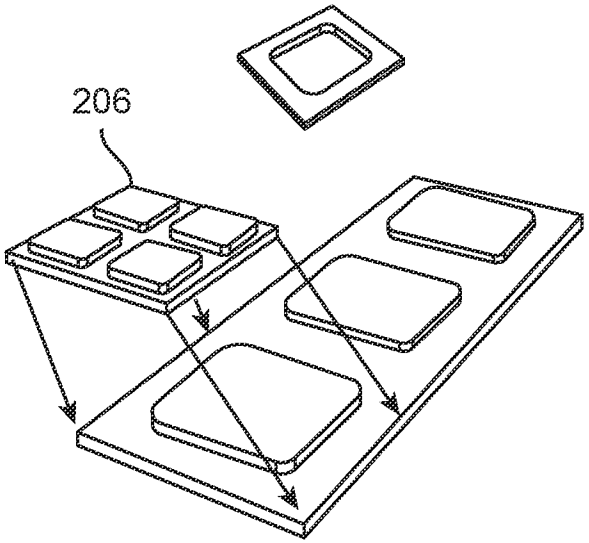
FIG. 3 depicts a medium base pan attachable to a large base ban.

The disclosed embodiments of the medium base pans 206, 208, 209 may be made up of two pieces of plastic and two sets of 4 magnets in the middle, i.e., a total of 8 magnets. In one embodiment, the medium base pans may stack on top of one of the large base pans 202, 204. The bottom of each medium base pan 206, 208, 209 may have an indented female shape, and it may sit directly on top of the protruding male shape of the large base pan 202, 204, such as shown in FIG. 3. There may be four protruding shapes and four magnets that sit in the inside of each of those protruding shapes in the medium base pan 206, 208, 209. The north side polarity of the magnet may face up. In the bottom panel, the medium base pan 206, 208, 209 may hold four additional magnets at the four corners. The placement of these magnets may be such that they correspond to the placement in the large base pan 202, 204. The north side polarity of the magnet may face up in this configuration. When stacked on top of the large base pan 202, 204, the south side polarity of the bottom four magnets of the medium base pan 206, 208, 210 align to the north side polarity of the magnets in the large base pan 202, 204. These medium base pans 206, 208, 209 may hold four long squarish cylinder cosmetic holders such as lipstick or lip gloss holder, as shown in FIGS. 2B-2C.

The system 200 may include additional cosmetic containers, such as a first cosmetic container for a liquid face product 214 and a second cosmetic container for a liquid face product 216. The first cosmetic container for a liquid face product 214 may attach to the second medium base pan 208, such as by magnets and/or interlocking protrusions as shown in FIG. 1. The second cosmetic container for a liquid face product 216 may also attach to the second medium base pan 208, such as by magnets and/or interlocking protrusions as shown in FIG. 1.

The system 200 may also include additional cosmetic containers, such as a cosmetic container for a mascara product 218. The cosmetic container for a mascara product 218 may attach to the first medium base pan 206, such as by magnets and/or interlocking protrusions as shown in FIG. 1.

The system 200 may also include additional cosmetic containers, such as a cosmetic container for a droplet application 220. The cosmetic container for a droplet application 220 may attach to the third medium base pan 209, such as by magnets and/or interlocking protrusions as shown in FIG. 1.

The system 200 may also include additional cosmetic containers, such as a first cosmetic container for foundation 222 and a second cosmetic container for foundation 224. The first cosmetic container for foundation 222 may attach to the first large base pan 202, such as by magnets and/or interlocking protrusions as shown in FIG. 1. The second cosmetic container for foundation 224 may attach to the second large base pan 204, such as by magnets and/or interlocking protrusions as shown in FIG. 1.

The system 200 may also include one or more open or empty containers 226. The open or empty container 226 may attach to the second large base pan 204, such as by magnets and/or interlocking protrusions as shown in FIG. 1. The open or empty container 226 may be used to hold brushes, cosmetic sponges, pencils, or the like. Empty containers 226 may come in a cup shape or the shape of a container with a lid. These empty containers 226 may hold other items such as pencils, brushes, cotton swabs, or cotton pads. These empty containers 226 may stack vertically on top of a large base pan or may attach horizontally on a wall-mounted large base pan (402, FIG. 4A).

The system 200 may also include one or more closed containers, such as a first closed container for a powder product 228 and a second closed container for a powder product 230. The first closed container for a powder product 228 may attach to the first large base pan 202, such as by magnets and/or interlocking protrusions as shown in FIG. 1. The second closed container for a powder product 230 may attach to the first large closed container for a powder product 228, such as by magnets and/or interlocking protrusions as shown in FIG. 1.

The specific arrangement of cosmetics shown in FIG. 2A is only for purposes of illustration. These cosmetics may be arranged in any order based on the needs and preferences of a user. Accordingly, the user may arrange the cosmetics containers in an ideal configuration based on their own preferences.

The cosmetic containers may sit directly on top of base pans 202, 204, 206, 208, 209 and may stack on top of each other using male-female shapes and strategically placed magnets. The cosmetic containers may include, but are not limited to: Liquid foundation, Face wash, Face creams, Face serums, Concealer, Face oil, Eye cream, Face primer, Setting powder, Setting spray, Face emulsions, Liquid eye shadow, Liquid blush, Mascara, Brow gel, Lip gloss, lip oil, Lipstick, lip balm, Powder foundation, Powder blush and bronzer, and Eyeshadow palette. The cosmetic containers may have a magnet on the top (either on the top cap or top component of a compact) and a magnet on the bottom, as shown in FIG. 1, or any combination thereof. The top of the container may have a male shape, and the bottom of the container may have a female indented shape. These cosmetic containers may stack on top of each other without small base pans or large base pans. Depending on the shape, middle base pans may also stack on top of these containers.

The cosmetic containers may hold cosmetics in different forms, such as liquid, solid, pressed powder, loose powder, and the like. At their base, the cosmetic containers may contain magnets that either attach directly to large base pan 202, 204, or to medium base pan 206, 208, 209. In some embodiments, cosmetic containers may attach directly to a medium base pan 206, 208, 209, such as containers for lipstick, lip balm, liquid lip gloss, liquid lipstick, liquid with concealer, liquid eyeshadow, mascara, and droplet applicators. In some embodiments, cosmetic containers may attach directly to the large base pan 202, 204, such as containers for a powder compact for powder foundation, powder bronzer, powder blush; a powder compact for eyeshadow and eyeshadow palette; a loose powder jar; and a foundation airless pump container. When cosmetic containers, such as lip gloss containers, are on top of the base pans, a small space between the two containers may exist, for example, a small pocket or opening allowing the flow of a liquid or air.

FIG. 2B depicts a perspective view of the cosmetic storage system 200 of FIG. 2A. FIG. 2C depicts a top view of the cosmetic storage system 200 of FIG. 2A. As shown in FIGS. 2B-2C, an additional row of certain cosmetics may be present for smaller cosmetic containers, such as the droplet applicator. Larger cosmetic containers, such as those for foundation, may occupy both rows.

FIG. 3 depicts a medium base pan attachable to a large base ban. The large base pan may be the first large base pan 202 of FIG. 2A. The medium base pan may be the first medium base pan 206 of FIG. 2A. The medium base pan 206 may be detachably attached to the large base pan 202. In some embodiments, each male protrusion of the large base pan 202 may receive one medium base pan 206, where each medium base pan 206 provides four smaller protrusions. A larger cosmetic container, such as a foundation container shown in FIG. 2A may fit on a single protrusion of the large base pan 202. A smaller cosmetic container, such as the mascara product container, may fit in a single smaller protrusion on the medium base pan 206.

FIG. 4A depicts a container attached to a wall-mounted large base pan 402 where the base pan 402 is perpendicular to a local plane (the local plane itself being parallel to the surface of the earth). The container may be an open or empty container 226, as shown in FIG. 2A. The open or empty container 226 may be used to hold brushes, cosmetic sponges, pencils, or the like. The wall-mounted large base pan 402 may be attached to a wall, fridge door, or another surface perpendicular to a ground level. The large wall-mounted base pan 402 may be attached via an adhesive, magnets, or any mechanisms for attachment to such surfaces. The large wall-mounted base pan 402 may include a backing 404 and one or more indentations 406 extending out from the backing 404 to receive one or more corresponding indentations of an open or empty container 226. In some embodiments, the indentations 406 may include one or more magnets disposed beneath the surface of the indentations 406. In some embodiments, the corresponding indentations of the open or empty container 226 may include one or more corresponding magnets. In some embodiments, the open or empty container 226 may attach to the wall-mounted large base pan 402 via friction fit or similar mechanisms.

Figure 4B:
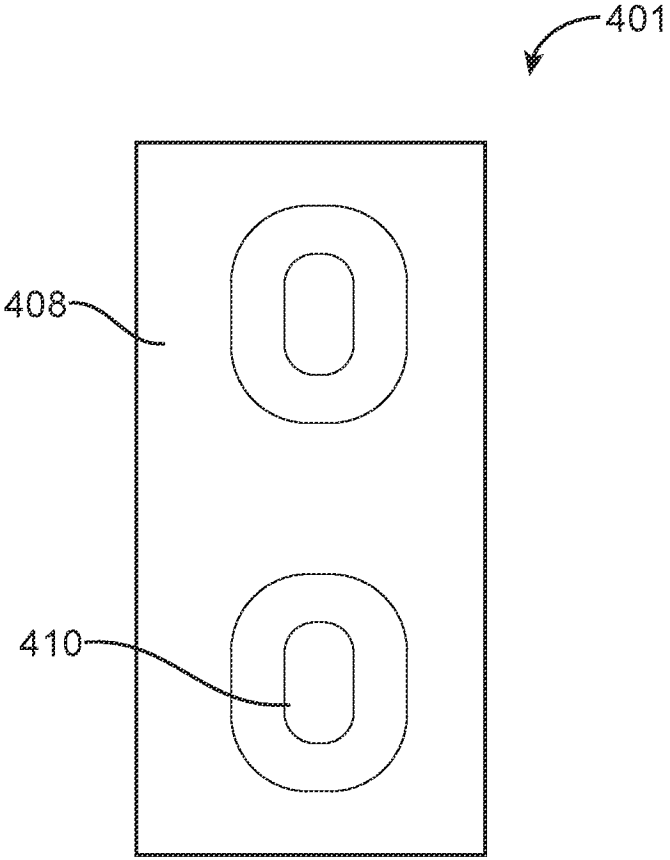
FIG. 4B depicts an alternate wall-mounted base pan.

FIG. 4B depicts an alternate wall-mounted base pan 401. The wall-mounted base pan 401 may include a backing 408 and one or more indentations 410 extending out from the backing 408 to receive one or more corresponding indentations of a container. The wall-mounted base pan 401 may have softer edges and ridges on these indentations 410 for the magnets of the corresponding containers to attach onto.

Figure 5B:
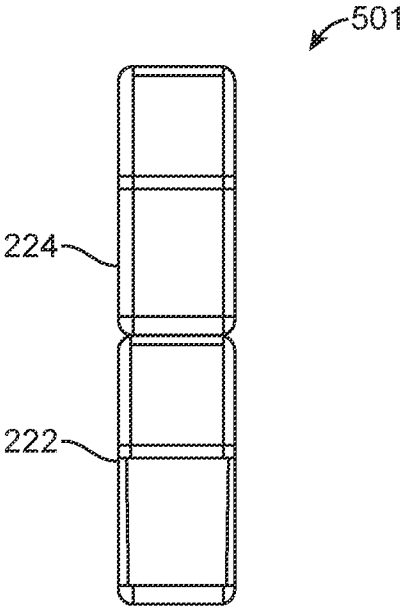
FIG. 5B depicts two containers connected to one another.
Figure 5A:
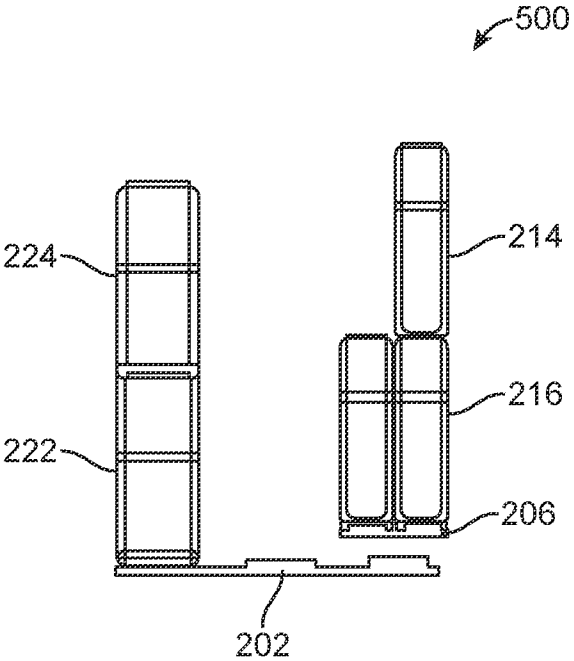
FIG. 5A depicts various containers attached to a base pan.

FIG. 5A depicts various containers attached to a base pan in one arrangement 500. The base pan may be the first large base pan 202 of FIG. 2A. The first cosmetic container for foundation 222 of FIG. 2A may be attached to the first large base pan 202. The second cosmetic container for foundation 224 of FIG. 2A may be attached to the first cosmetic container for foundation 222. A first medium base pan 206 of FIG. 2A may be attached to the first large base pan 202. The second cosmetic container for a liquid face product 216 of FIG. 2A may be attached to the first medium base pan 206. A first cosmetic container for a liquid face product 214 of FIG. 2A may be attached to the second cosmetic container for a liquid face product 216. Each cosmetic container may be attached to either: another cosmetic container or a base pan.

FIG. 5B depicts two containers 222, 224 connected to one another in another arrangement 501. The containers 222, 224 are not connected to any base pans, as in FIG. 5A. There may be some containers that do not have a male shape that sticks up but has a female indented shape at the bottom. In such embodiment, the magnets at the bottom of the container would be placed around the edge of the container so that the containers may still be strategically stacked on top of each other. In some embodiments, the cosmetic containers 222, 224 may be a refillable system.

Figure 6A:
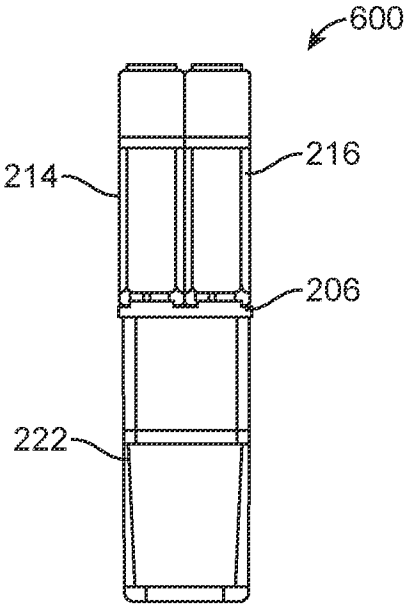
FIG. 6A depicts various sized containers connected to one another.

FIG. 6A depicts various sized containers connected to one another in another arrangement 600. The cosmetic containers 214, 216, 206, 222 of FIGS. 2A and 5 have been rearranged to show another arrangement where the lowest level item may be a cosmetic container instead of a base pan. The medium base pan 206 is placed on top of the cosmetic container 222, and the cosmetic container 222 does not have a lower portion attached to a base pan.

Figure 6C:
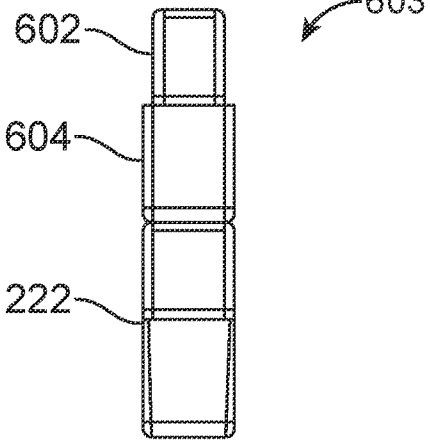
FIG. 6C depicts two containers having different shapes connected together.
Figure 6B:
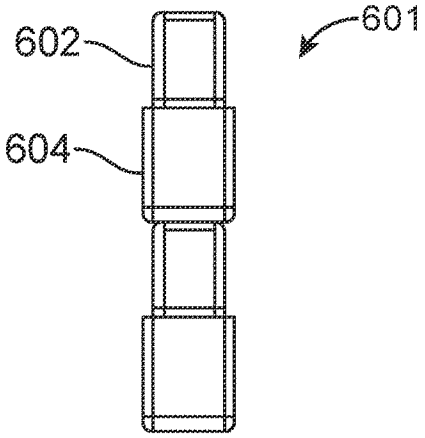
FIG. 6B depicts two containers having different sized bottles and caps connected together.

FIG. 6B depicts two containers having different-sized bottles and caps connected together in an arrangement 601. Each container has a cap 602 having a smaller width and/or length than a width and/or length of the bottle 604. The containers are able to be connected even with different sized or shaped caps 602 and bottles 604.

FIG. 6C depicts two containers having different shapes connected together in an arrangement 603. The top container has a cap 602 having a smaller width and/or length than a width and/or length of the bottle 604, such as shown in FIG. 6B. The bottom container 222 has a cap and bottle having the same and/or similar width, length, and/or shape. These containers may be intermixed and still connect to one another.

Figure 6E:
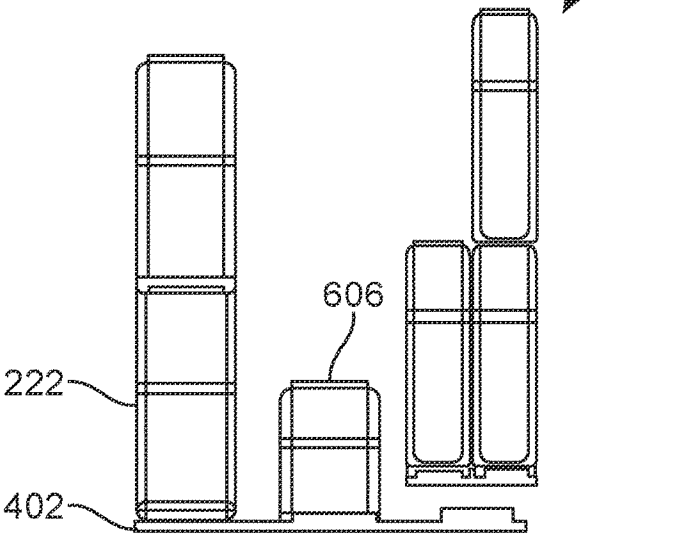
FIG. 6E depicts containers of different heights and shapes connected together and to abase pan.
Figure 6D:
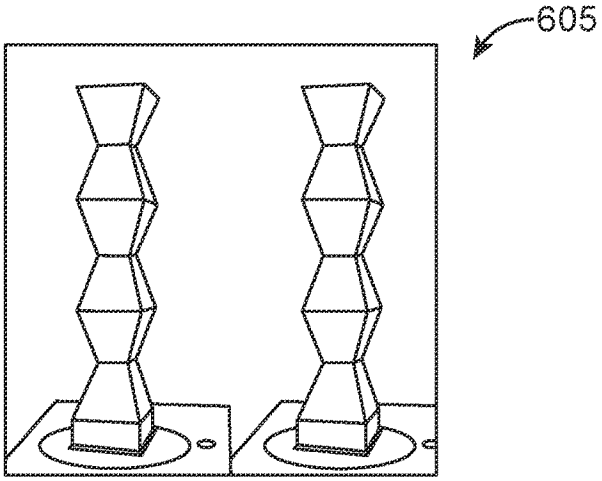
FIG. 6D depicts containers having varying profiles connected together.

FIG. 6D depicts containers having varying profiles connected together in an arrangement 605. The sides of each container may be diagonal, curved, and/or in other various shapes. These containers may connect to other containers having the same size as shape, as in FIG. 6B, or connect to containers having varying sizes and shapes, as in FIG. 6C.

FIG. 6E depicts containers of different heights and shapes connected together and to a base pan in an arrangement 607. The containers may be different sizes or even different heights and still connect to one another and/or to a base pan. In one example, cosmetic container 222 is connected to base pan 402. Another cosmetic container 606 is also connected to base pan 402. The height of cosmetic container 606 is about half of the height of cosmetic container 222, such that two cosmetic containers 606 could be stacked together to form the height of cosmetic container 222. In some embodiments, the cosmetic container heights may be standardized so as to allow for stacking at consistent heights, such as ½ height containers, ⅓ height containers, ¼ height containers, and the like. In other embodiments, the cosmetic container heights may be varied based on the requirements for each cosmetic container.

Figure 7B:
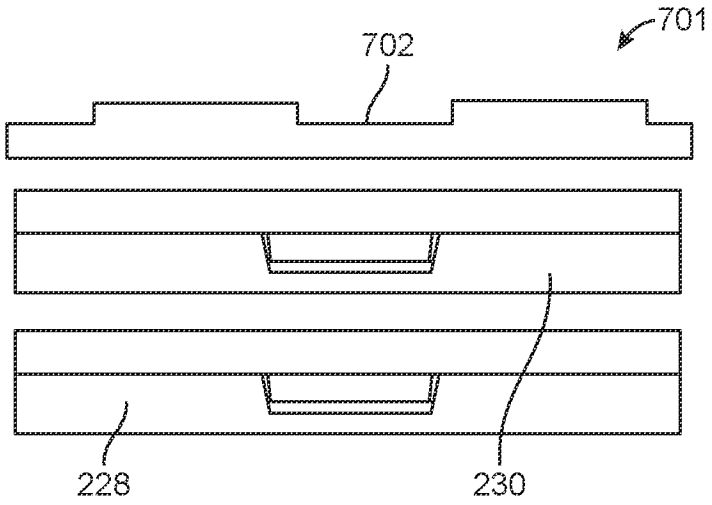
FIG. 7B depicts two containers connected to one another and a base pan connected to a top of one of the two containers.
Figure 7A:
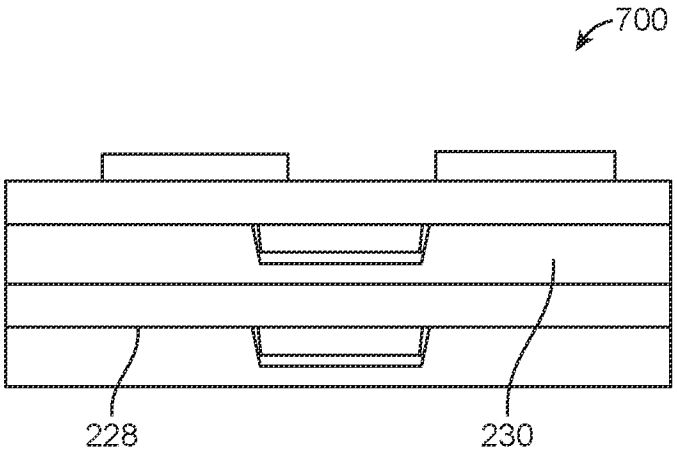
FIG. 7A depicts two containers connected to one another.

FIG. 7A depicts two containers connected to one another in another arrangement 700 without base pans. In this arrangement 700, the first closed container for a powder product 228 of FIG. 2A and the second closed container for a powder product 230 of FIG. 2A are connected. The second closed container for a powder product 230 may attach to the first large closed container for a powder product 228, such as by magnets and/or interlocking protrusions as shown in FIG. 1.

FIG. 7B depicts two containers connected to one another and a base pan connected to a top of one of the two containers in another arrangement 701. The first closed container for a powder product 228 of FIG. 2A and the second closed container for a powder product 230 of FIG. 2A are connected. A base pan 702 is attached to the top of the second closed container for a powder product 230 by magnets. The top surface of the second closed container for a powder product 230 may be flat. The bottom surface of the base pan 702 may be flat or may have female indentations. The base pan 702 may be detachably attached to the second closed container for a powder product 230 via magnets.

FIG. 8A depicts two containers having different indented female shapes detached from a base pan having a same male shape. The base pan includes two or more male indentations 802, 804 having a same shape, such as an eight-point star shape. A first container comprises a female indentation having a corresponding eight-point star shape 806. A second container comprises a female indentation having a circular shape 808.

Figure 8B:
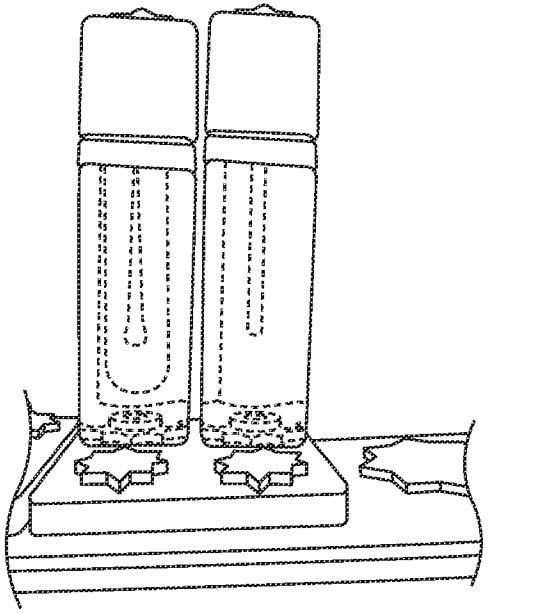
FIG. 8B depicts the two containers attached to the base pan of FIG. 8A.
Figure 8A:
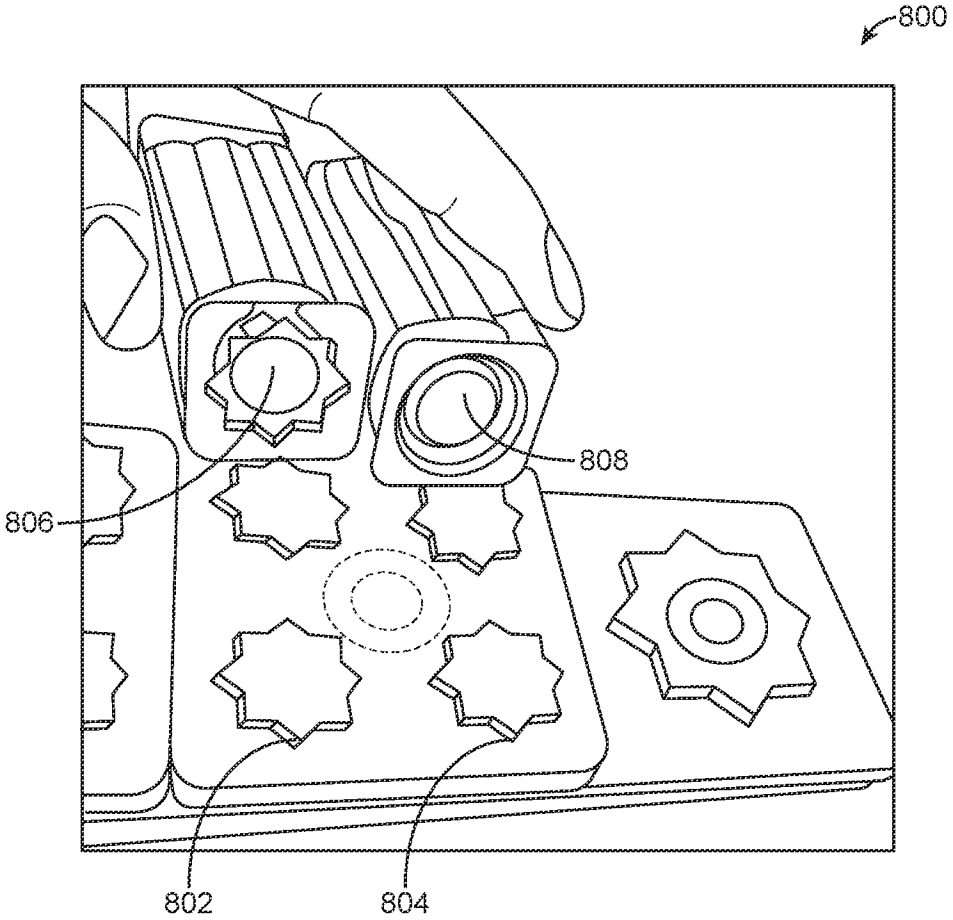
FIG. 8A depicts two containers having different indented female shapes detached from a base pan having a same male shape.

FIG. 8B depicts the two containers attached to the base pan of FIG. 8A. The female eight-point star indentation 806 and the female circular indentation 808 both receive the male eight-point star indentations 804 of the base pan. Accordingly, the female and/or male indentations of the container and base pan, respectively, may be varied while still being compatible in some embodiments.

The storage and organization of cosmetics is a problem for many people. There are many different cosmetic products which all have different shapes, for example: lipstick, lip gloss, concealer, eyeshadow, eyebrow pencils, eyeliner, mascara, blush, bronzer, face wash, face serums, and cosmetic brushes.

Storage containers may come in a pre-formed structure with immovable parts. As a result, if a user is trying to store an object that does not fit in a predetermined structure, then the user is prevented from using it. Some existing containers may include a pre-formed number of compartments which does not allow a user to modularly build upon a storage system as needed. These pre-formed structures are largely impractical for travel. Storage containers may include open boxes and/or a pullout tray. If this type of storage container is knocked over, then everything that is stored inside or in the open compartments will fall out of place.

Alternatively, storage containers may include soft zippered pouches. These pouches may be used primarily for travel and for holding a limited number of products. These pouches may not allow for organization because all different types of products are stored together in the same space. While it may be visually easy for someone to select the item they are looking for, items may move around and get disorganized while in transit. Storage containers may include wall-mounted solutions. These wall-mounted containers may be a predefined shape with immovable parts. Things may easily fall out of these containers as they may not be very secure.

Rigid shapes of storage systems may mean that the system is not modular, and not all makeup shapes will fit into the storage system because it wasn't designed together. Zipper bags for makeup may not be useful for organizing and seeing different component parts. Organizing systems for the home may not be well designed for travel. Any of these organizers may be knocked down or over, resulting in things being out of order or disorganized. When selected makeup is taken off of and/or out of a storage system, then the storage system may lose its organization. Storage systems do not provide a mechanism to be clustered together.

Accordingly, the disclosed embodiments are configured to provide a cosmetic storage system that may be modularly built as needed and practical for in-home use and/or travel. Such modularization may effectuate the organization of cosmetic products having different shapes and sizes, where shapes may be created dynamically with movable parts and the disclosed mechanisms.

Figure 9:
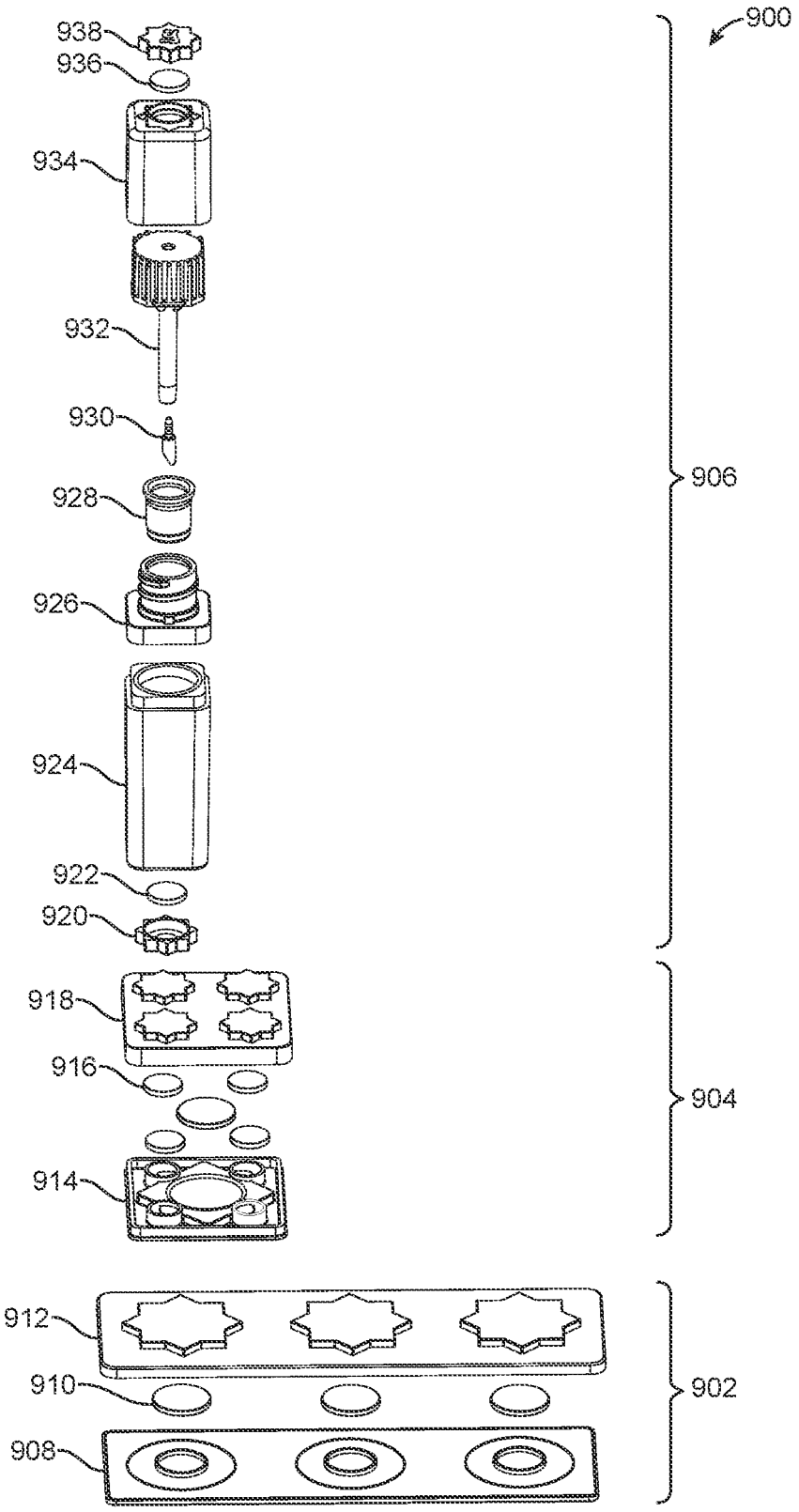
FIG. 9 depicts an exploded perspective view of another embodiment of a cosmetic storage system.

FIG. 9 depicts an exploded perspective view of another embodiment of a cosmetic storage system 900. The system 900 may include a large base pan 902, a medium base pan 904, and a cosmetic container 906. The large base pan 902 may include a large base 908, one or more magnets 910, and a large cover 912. The large cover 912 may be placed over the large base 908 with the one or more magnets 910 located therebetween. The large base pan 902 is depicted as having three male protrusions, such as an eight-sided star. In other embodiments, the large base pan 902 may have female protrusions. In other embodiments, the large base pan 902 may be flat. Other protrusion shapes are possible and contemplated.

The medium base pan 904 may include a square base 914, one or more magnets 916, and a square cover 918. The square cover 918 may be placed over the square base 914 with the one or more magnets 916 located therebetween. The medium base pan 904 is depicted as having four male protrusions, such as an eight-sided star. In other embodiments, the medium base pan 904 may have female protrusions. In other embodiments, the medium base pan 904 may be flat. Other protrusion shapes are possible and contemplated. The medium base pan 904 may have a female indentation corresponding to the male indentation on the top of the large base pan 902. In some embodiments, three medium base pans 904 may be attached to each large base pan 902. Other numbers and combination of attachments is possible and contemplated.

A bottle 924 may have at least one magnet 922 disposed in a bottom portion of the bottle 924. The magnet 922 of the bottle 924 may attract the at least one magnet 916 of the medium base 904 so as to secure the bottle 924 to the medium base 904.

A collar 926 may be attached to a top portion of the bottle 924. The top portion of the bottle 924 may be disposed distal from the bottom portion of the bottle 924. A plug 928 may be disposed in an opening of the collar 926.

An inner cap 932 may be connected to an applicator 930. The applicator 930 may vary based on the type of cosmetic being stored. For example, an applicator for a lip gloss applicator may vary from an applicator for a mascara. Various makeup applicators 930 are possible and contemplated. The inner cap 932 may be secured to the collar 926 when not in use, such as by screw threads, friction fit, or the like.

A cap 934 may be placed over the inner cap 932. The cap 934 may be attached to the collar 926 and/or bottle 924 to secure the cap 934 to the collar 926 and/or bottle 924. A magnet 936 may be disposed in a portion of the cap 934. A top cap 938 may be disposed over the cap 934 in some embodiments. In some embodiments, the top cap 938 may secure the magnet 936 within the cap 934.

The system may include one or more indentations in the cap 934 and/or bottle 924. The bottle 924 may contain a female indentation configured to receive the male indentation of the square cover 918 of the medium base pan 904. The female indentation of the bottle 924 may be a corresponding shape to the shape of the male indentation of the square cover 918 or a shape configured to receive the male indentation of the square cover 918, such as seen in FIG. 8A. In some embodiments, the top cap 938 may be used to convert the cap 934 from a female indentation to a male indentation, where such a female indentation may be connected to the male indentation of the cap 934 and top cap 938.

The cosmetic container 906 may include the inner cover 920, magnet 922, bottle 924, collar 926, plug 928, applicator 930, inner cap 932, cap 934, magnet 936, and top cap 938. The medium base pan 904 may include the square base 914, one or more magnets 916, and the square cover 918. The large base pan 902 may include the large base 908, one or more magnets 910, and the large cover 912.

Figure 10B:
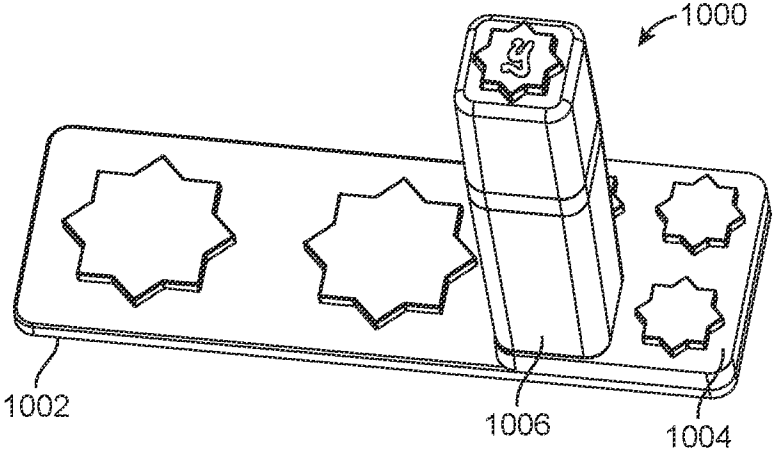
FIG. 10B depicts a top perspective view of the cosmetic storage system of FIG. 10A.
Figure 10A:
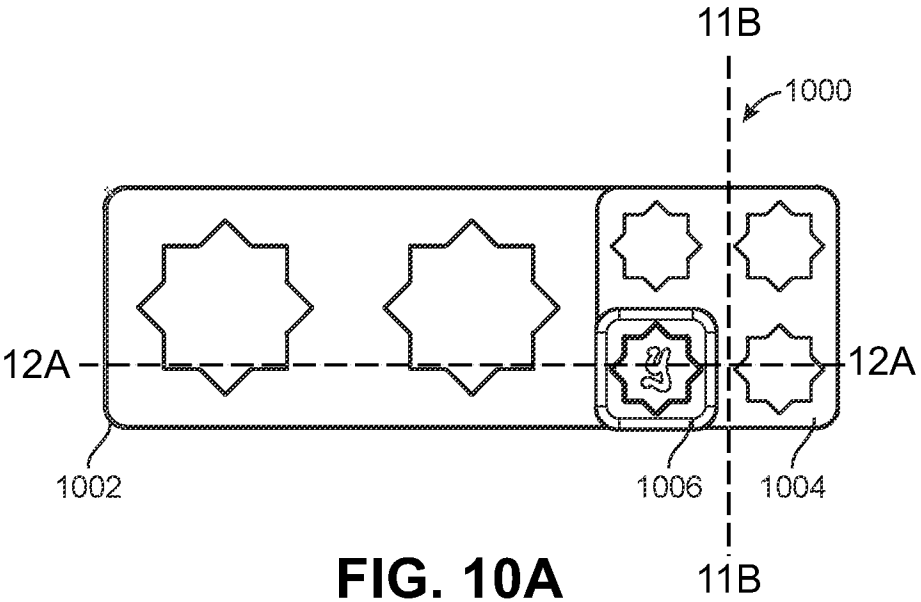
FIG. 10A depicts a top view of a cosmetic storage system having a large base pan, a medium base pan attached to the large base pan, and a cosmetic container attached to the medium base pan.
Figure 10C:
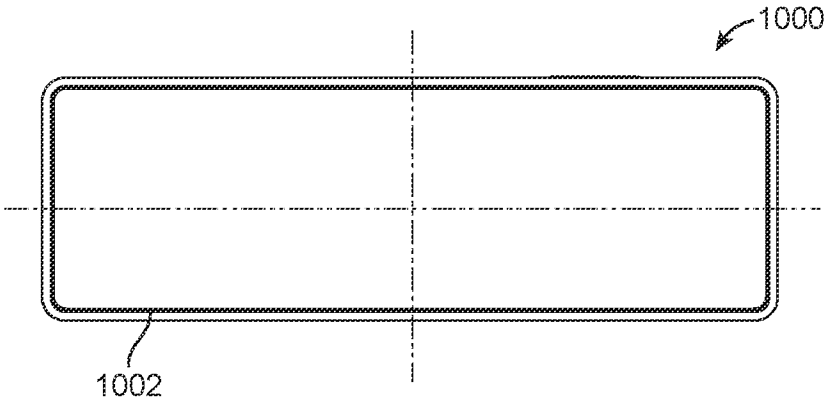
FIG. 10C depicts a bottom view of the cosmetic storage system of FIG. 10A.

FIG. 10A depicts a top view of a cosmetic storage system 1000 having a large base pan 1002, a medium base pan 1004 attached to the large base pan 1002, and a cosmetic container 1006 attached to the medium base pan 1004. FIG. 10B depicts a top perspective view of the cosmetic storage system 1000 of FIG. 10A. The medium base pan 1004 is attached to the large base pan 1002. The cosmetic container 1006 is attached to the medium base pan 1004. FIG. 10C depicts a bottom view of the cosmetic storage system 1000 of FIG. 10A. The large base pan 1002 has a flat bottom. In some embodiments, the bottom of the large base pan 1002 may have a male indentation or a female indentation.

Figure 11B:
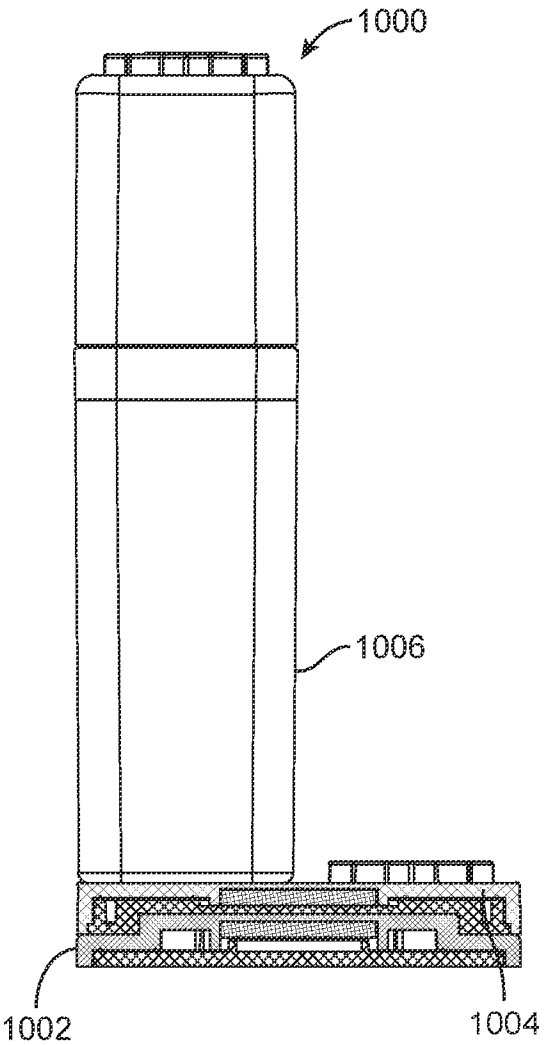
FIG. 11B depicts a right side view of the cosmetic storage system of FIG. 10A.
Figure 11A:
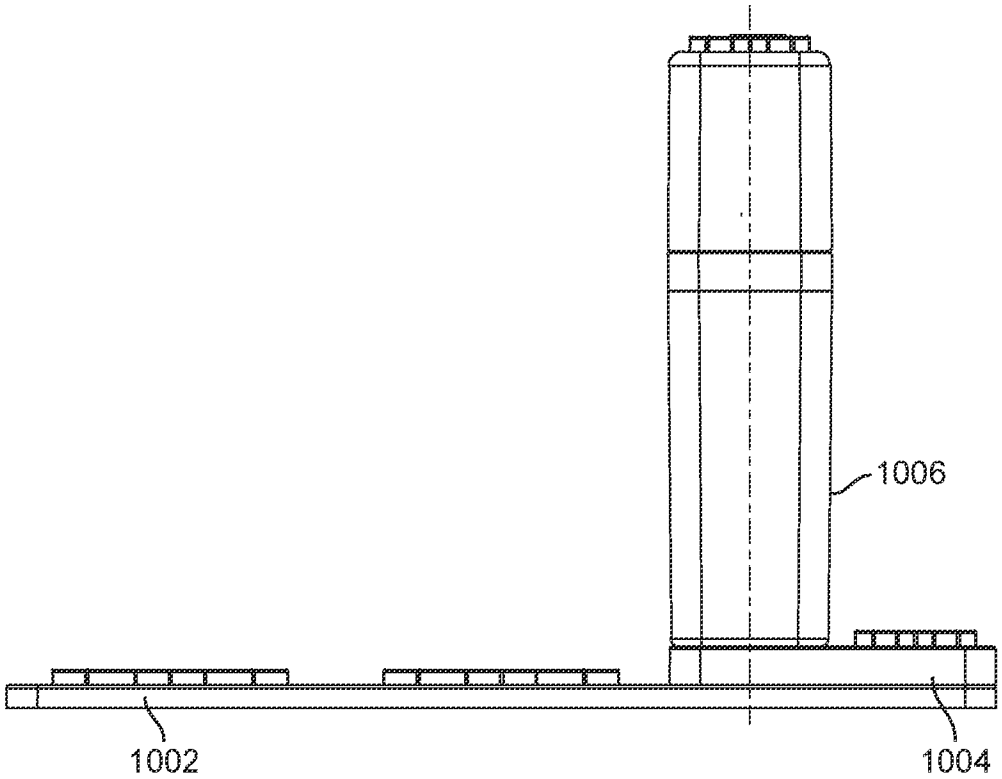
FIG. 11A depicts a front view of the cosmetic storage system of FIG. 10A.

FIG. 11A depicts a front view of the cosmetic storage system 1000 of FIG. 10A. The medium base pan 1004 is attached to the large base pan 1002. The cosmetic container 1006 is attached to the medium base pan 1004. FIG. 11B depicts a right side view of the cosmetic storage system 1000 of FIG. 10A. The medium base pan 1004 is attached to the large base pan 1002. The cosmetic container 1006 is attached to the medium base pan 1004.

Figure 12C:
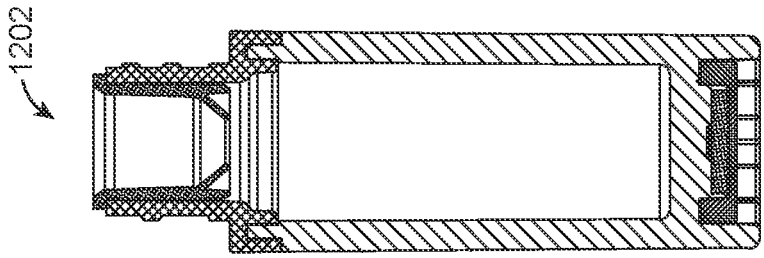
FIG. 12C depicts a cross-sectional view of a second portion of the cosmetic container of FIG. 12A including the bottle and collar.
Figure 12B:
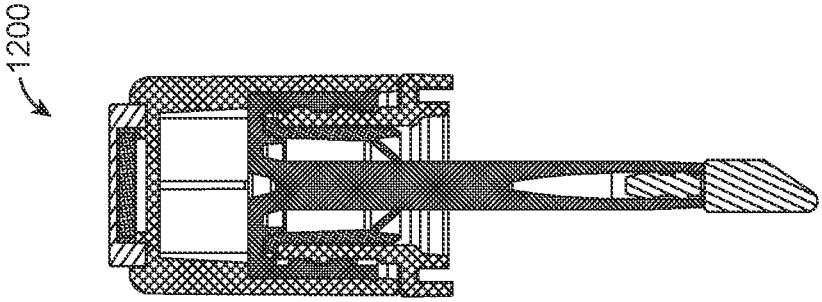
FIG. 12B depicts a cross-sectional view of a first portion of the cosmetic container of FIG. 12A including the cap and applicator.
Figure 12A:
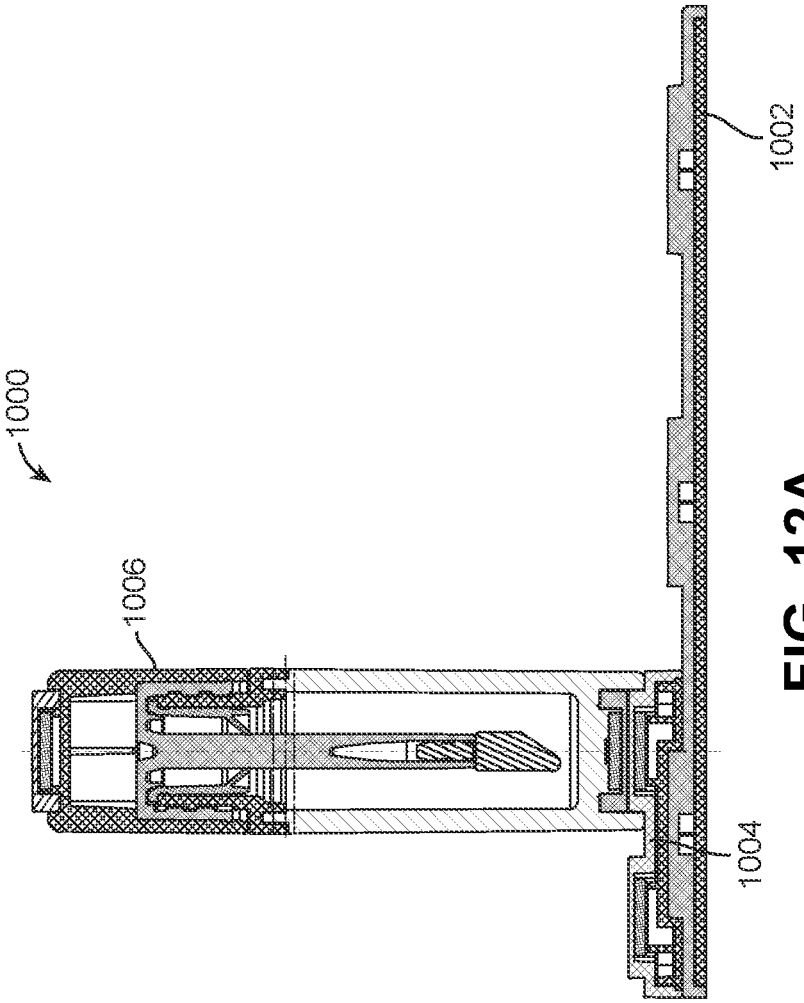
FIG. 12A depicts a rear cross-sectional view of the cosmetic storage system of FIG. 10A.

FIG. 12A depicts a rear cross-sectional view of the cosmetic storage system 1000 of FIG. 10A. The medium base pan 1004 is attached to the large base pan 1002. The cosmetic container 1006 is attached to the medium base pan 1004. FIG. 12B depicts a cross-sectional view of a first portion 1200 of the cosmetic container of FIG. 12A including the cap and applicator. FIG. 12C depicts a cross-sectional view of a second portion 1202 of the cosmetic container of FIG. 12A including the bottle and collar.

Figure 13:
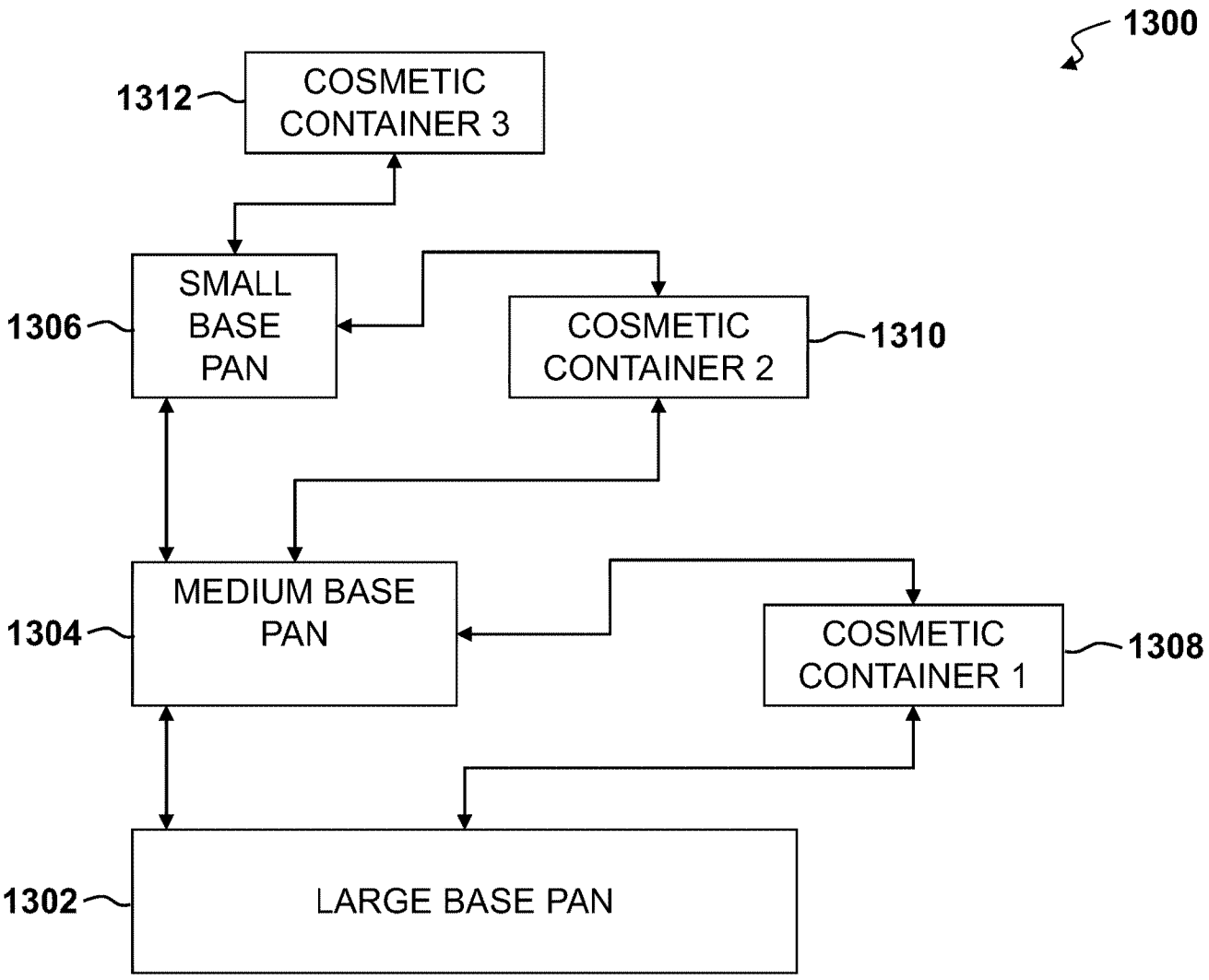
FIG. 13 depicts a high-level block diagram of a cosmetic storage system.

FIG. 13 depicts a high-level block diagram of a cosmetic storage system 1300. The system includes one or more base pans 1302, 1304, 1306, and one or more cosmetic containers 1308, 1310, 1312. While a large base pan 1302, medium base pan 1304, and small base pan 1306 are depicted, any number and size of base pan is possible and contemplated. While three cosmetic containers 1308, 1310, 1312 are depicted, any number of cosmetic containers is possible and contemplated. Further, in some embodiments, no base pans may be used, and two or more cosmetic containers 1308, 1310, 1312 may be connected to one another.

A large base pan 1302 may have one or more male or female protrusions on a top surface for receiving a medium base pan 1304 and/or a first cosmetic container 1308. The first cosmetic container 1308 may have a corresponding male or female protrusion on a bottom surface configured to receive the male or female protrusion of the large base pan 1302. The medium base pan 1304 may have a corresponding male or female protrusion on the bottom surface configured to receive the male or female protrusion of the large base pan 1302 and/or the male or female protrusion of the first cosmetic container 1308. The medium base pan 1304 may have one or more male or female protrusions on the top surface for receiving a small base pan 1306 and/or a second cosmetic container 1310. The small base pan 1306 may have a corresponding male or female protrusion on the bottom surface configured to receive the male or female protrusion of the medium base pan 1304 and/or the male or female protrusion of the third cosmetic container 1312. The small base pan 1306 may have one or more male or female protrusions on the top surface for receiving the third cosmetic container 1312.

Figure 14B:
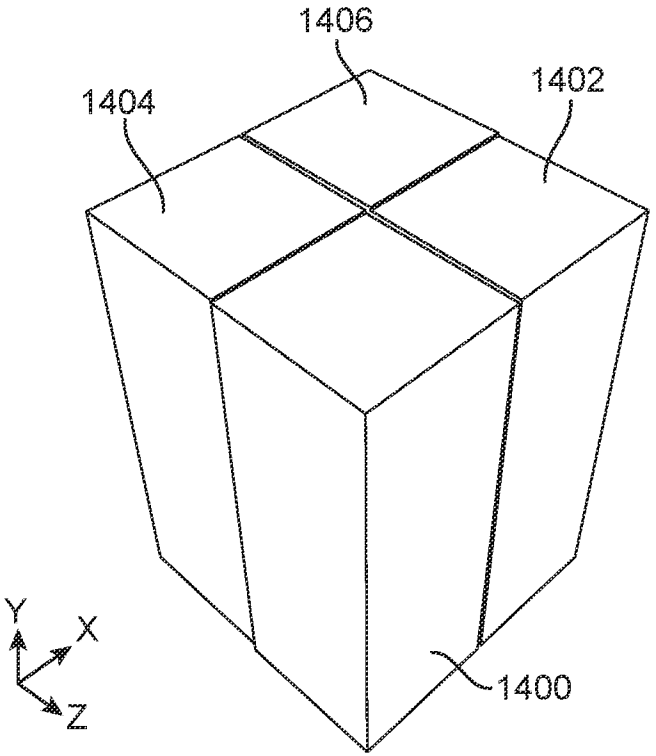
FIG. 14B depicts a perspective view of the connected cosmetic containers of FIG. 14A.
Figure 14A:
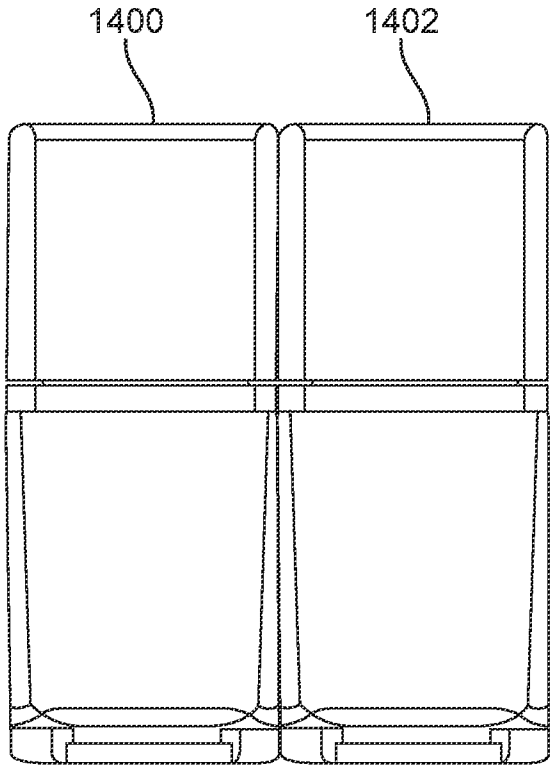
FIG. 14A depicts a front view of cosmetic containers connected to one another by side magnets.

FIG. 14A depicts a front view of cosmetic containers 1400,1402,1404,1406 connected to one another by side magnets. FIG. 14B depicts a perspective view of the connected cosmetic containers 1400,1402,1404,1406 of FIG. 14A. The cosmetic containers 1400,1402,1404,1406 may have magnets on one or more sides so that they are configured to attach to each other. In this embodiment, the cosmetic containers 1400,1402,1404,1406 may be organized without the need for attaching to a base pan. In some embodiments, magnets may also be at the base and/or cap of the cosmetic containers 1400,1402,1404,1406. The magnets may also be located on some of the sides, on the corners of the shapes, and/or on all sides of the cosmetic containers 1400,1402,1404,1406. While a square shape is shown in FIG. 14B, the cosmetic containers 1400,1402,1404,1406 may be arranged in any combination horizontally and vertically based on the placement of the magnets.

Figure 15A:
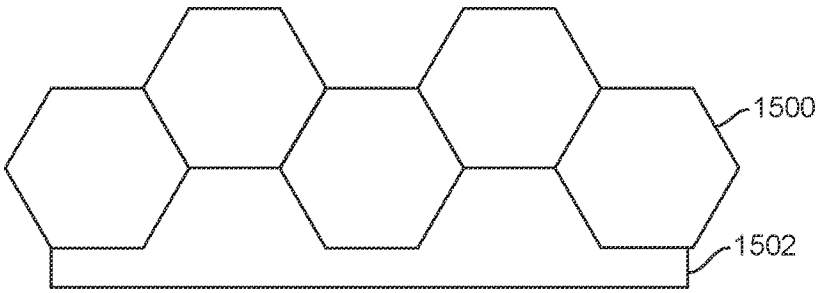
FIG. 15A depicts one embodiment of a base pan for holding cosmetic containers vertically.
Figure 15B:
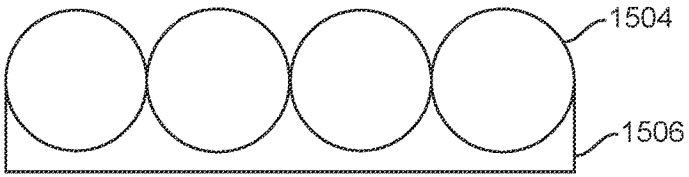
FIG. 15B depicts another embodiment of a base pan for holding cosmetic containers vertically.
Figure 15C:
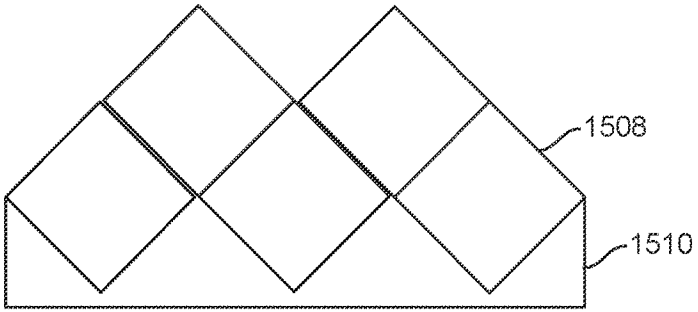
FIG. 15C depicts another embodiment of a base pan for holding cosmetic containers vertically where cosmetic containers are also connected to one another.

FIG. 15A depicts one embodiment of a base pan 1502 for holding cosmetic containers 1500 vertically. FIG. 15B depicts another embodiment of a base pan 1506 for holding cosmetic containers 1504 vertically. The base pans 1502, 1504 may have one or more ridges that are angular (FIG. 15A) or circular (FIG. 15B) so as to hold their respective cosmetic containers 1500,1504 horizontally, while still allowing for more makeup containers to stack above, as in FIG. 15C. In this embodiment, the magnets are placed on the side of each cosmetic container 1500,1504. The magnets may be located at the base and/or at the cap. The sides that correspond with each other may be flat or may have a male-female shape. The individual cosmetic containers 1500,1504 themselves may be organized together upright because of the magnets on their sides without the need for a base pan, in some embodiments. FIG. 15C depicts another embodiment of a base pan 1510 for holding cosmetic containers 1508 vertically, where cosmetic containers 1508 are also connected to one another. The cosmetic containers 1508 may connect to other cosmetic containers 1508 and/or the base pan 1510.

Figure 16:
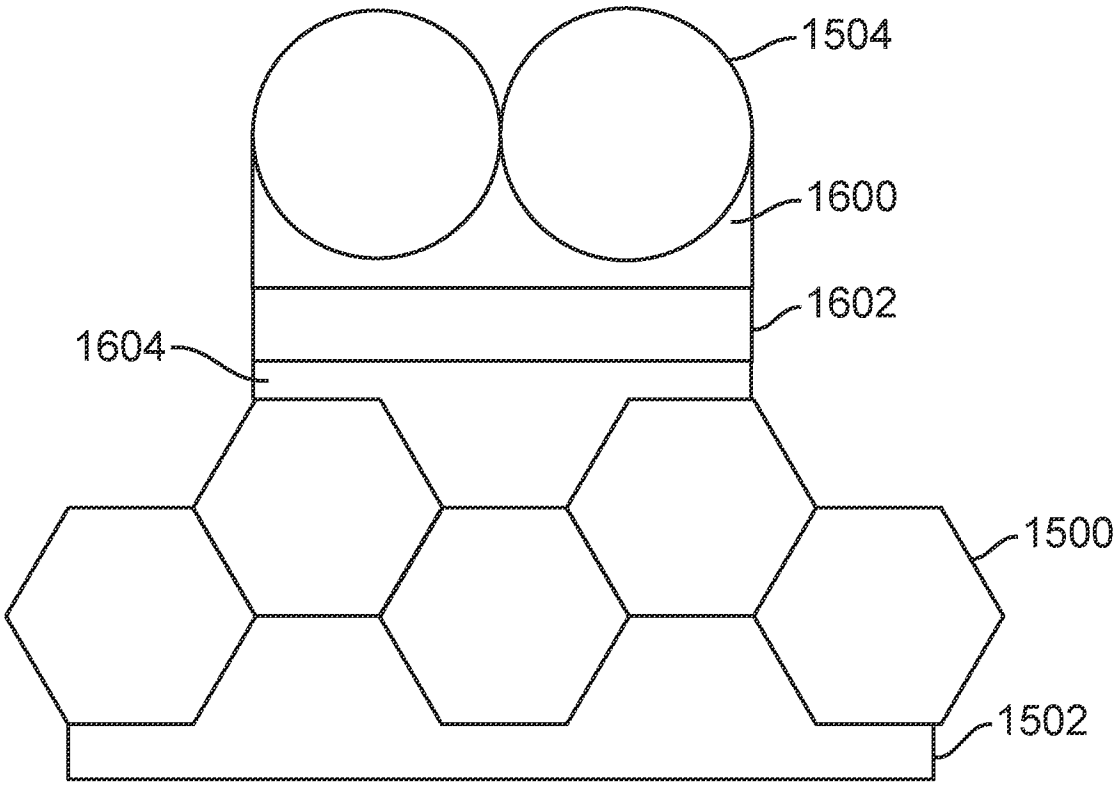
FIG. 16 depicts an arrangement of connected cosmetic containers and base pans.

FIG. 16 depicts an arrangement of connected cosmetic containers 1500, 1504 and base pans 1502,1600,1602,1604. Magnets on the cosmetic containers 1500,1504 may be placed in a multitude of places such as, but not limited to, the cap, the bottom, on the side(s), associated with male and/or female protruding shapes, round shapes and/or shapes with angles, and flat shapes. The magnets may be placed on the side of the cosmetic container 1500,1504, on the side of the cap, or both. The magnets may be on one side, two sides, or all sides. If the cosmetic container has one or more rounded edges, the magnets may go down lengthwise and still connect even if the shapes are not identical. The disclosed system does not need each cosmetic container 1500, 1504 shape to be the same for it to work. There may be embodiments where some shapes are square, rectangle, circular, hexagon, and for all of the pieces to still work as a stackable and modular storage system. Two round cosmetic containers 1504 are stacked on a medium base pan shape 1600, stacked on top of a flat makeup container 1602, stacked on top of a medium base pan shape 1604, stacked on top of five hexagon-shaped makeup containers 1500, stacked on top of a large base pan 1502. This arrangement is shown for the purposes of illustration only. Other combinations and arrangements of cosmetic containers 1500, 1504, and base pans 1502,1600,1602,1604 are possible and contemplated.

Figure 17:
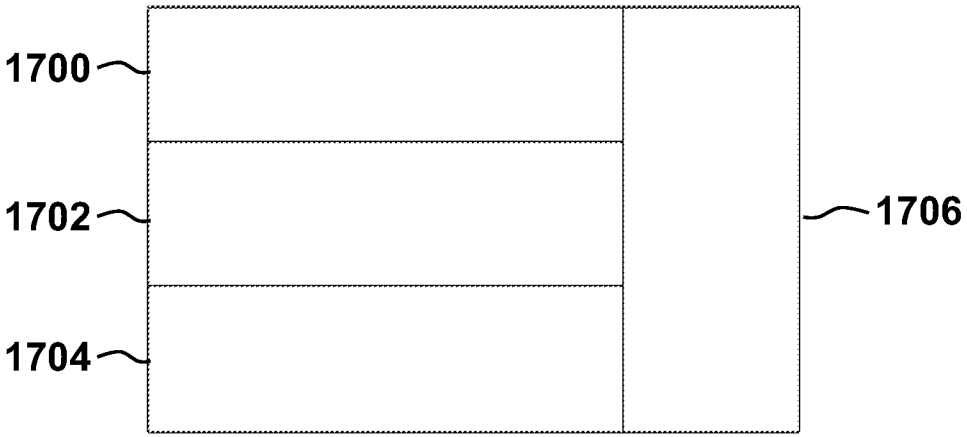
FIG. 17 depicts base pans connected to one another by side magnets.

FIG. 17 depicts base pans 1700,1702,1704,1706 connected to one another by side magnets. The large and medium base pans may have magnets on their sides so that they may attach and increase the surface area and allow for more modular options horizontally. For example, base pans 1700,1702,1704,1706 may be connected via magnets on the sides of each base pan 1700,1702,1704,1706 so as to form the larger shape shown in FIG. 17. Additional system components may be attached above and below each base pan as needed.

Figure 18B:
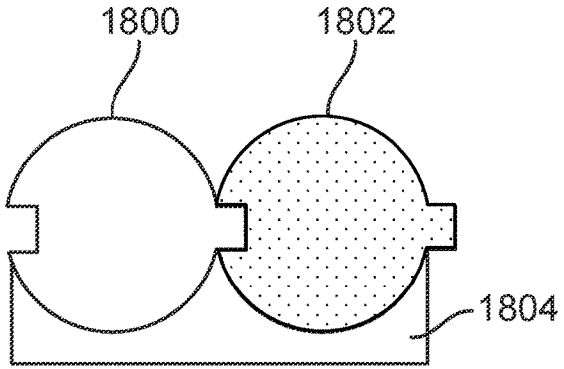
FIG. 18B depicts the pair of cosmetic container caps or bases of FIG. 18A connected to one another and to a base pan.
Figure 18A:
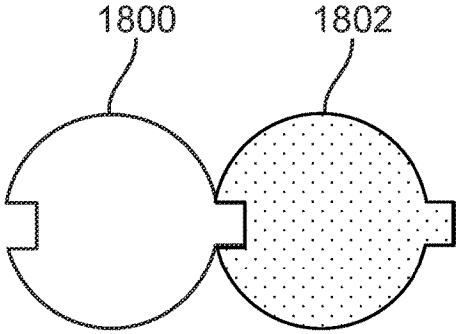
FIG. 18A depicts a pair of cosmetic container caps or bases connected together.

FIG. 18A depicts a pair of cosmetic container caps or bases 1800,1802 connected together. FIG. 18B depicts the pair of cosmetic container caps or bases 1800,1802 of FIG. 18A connected to one another and to a base pan 1804. In some embodiments, the male-female corresponding shapes may not be on the cap and bottom of the container but on one or more sides of each cosmetic container. In other embodiments, the male-female corresponding shapes may be on the cap and/or on the base. In one embodiment, the male-female corresponding shapes may be a circular shape with indented and protruding corresponding sides. Other shapes and arrangements are possible and contemplated.

Figure 18C:
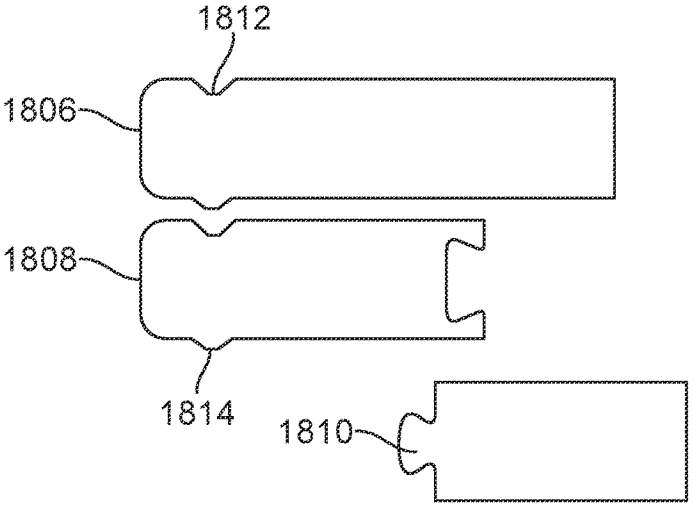
FIG. 18C depicts an alternate pair of cosmetic container caps or bases.

FIG. 18C depicts an alternate pair of cosmetic container caps or bases 1806, 1808, 1810. The first cosmetic container cap or base 1806 may include an indent 1812 for aligning the first cosmetic container cap or base 1806 with a corresponding protrusion 1814 on a second cosmetic container cap or base 1814. In some embodiments, the second cosmetic container cap or base 1808 may be extended lengthwise by connecting a third cosmetic container cap or base 1810. The second cosmetic container cap or base 1808 may have an indent that connects to a corresponding protrusion of the third cosmetic container cap or base 1810. In some embodiments, these indents may resemble jigsaw or puzzle pieces such that the cosmetic container caps or bases 1808, 1810 need to be fit together vertically and cannot be pulled apart by a lengthwise force.

Figure 19:
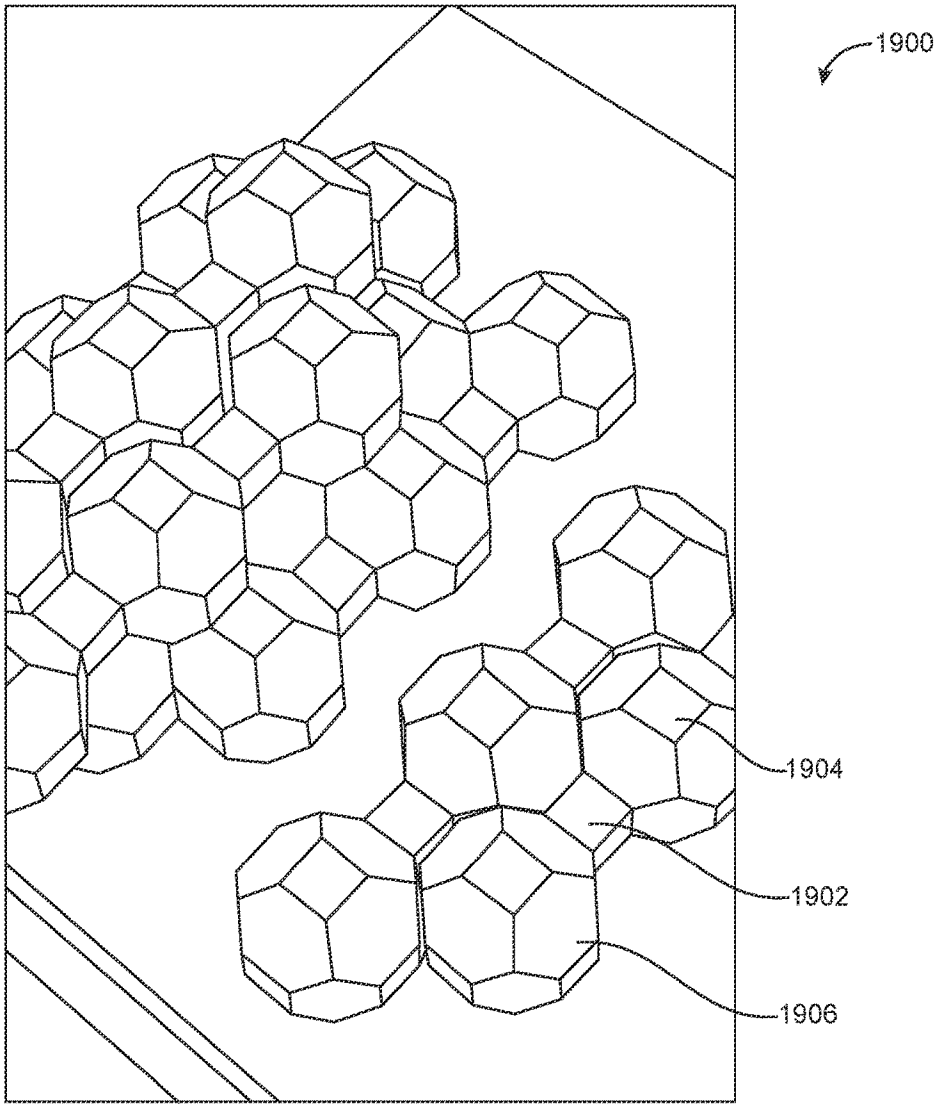
FIG. 19 depicts a perspective view of alternate cosmetic containers and bases.

FIG. 19 depicts a perspective view of alternate cosmetic containers and bases 1900. The arrangement may include a medium base pan 1902 and cosmetics containers 1904, 1906. In some embodiments, the cosmetic containers 1904, 1906 and base pans 1902 may have shapes with more than six sides, i.e., they are not limited to rectangular shapes. In the arrangement shown in FIG. 19 this shape variation supports being connected horizontally, as well as being stacked vertically. The different "stacks" also connect because of the unique shape. Magnets may be placed on any flat edges/planes of the cosmetic containers 1904, 1906 and base pans 1902 as needed.

Figure 20:
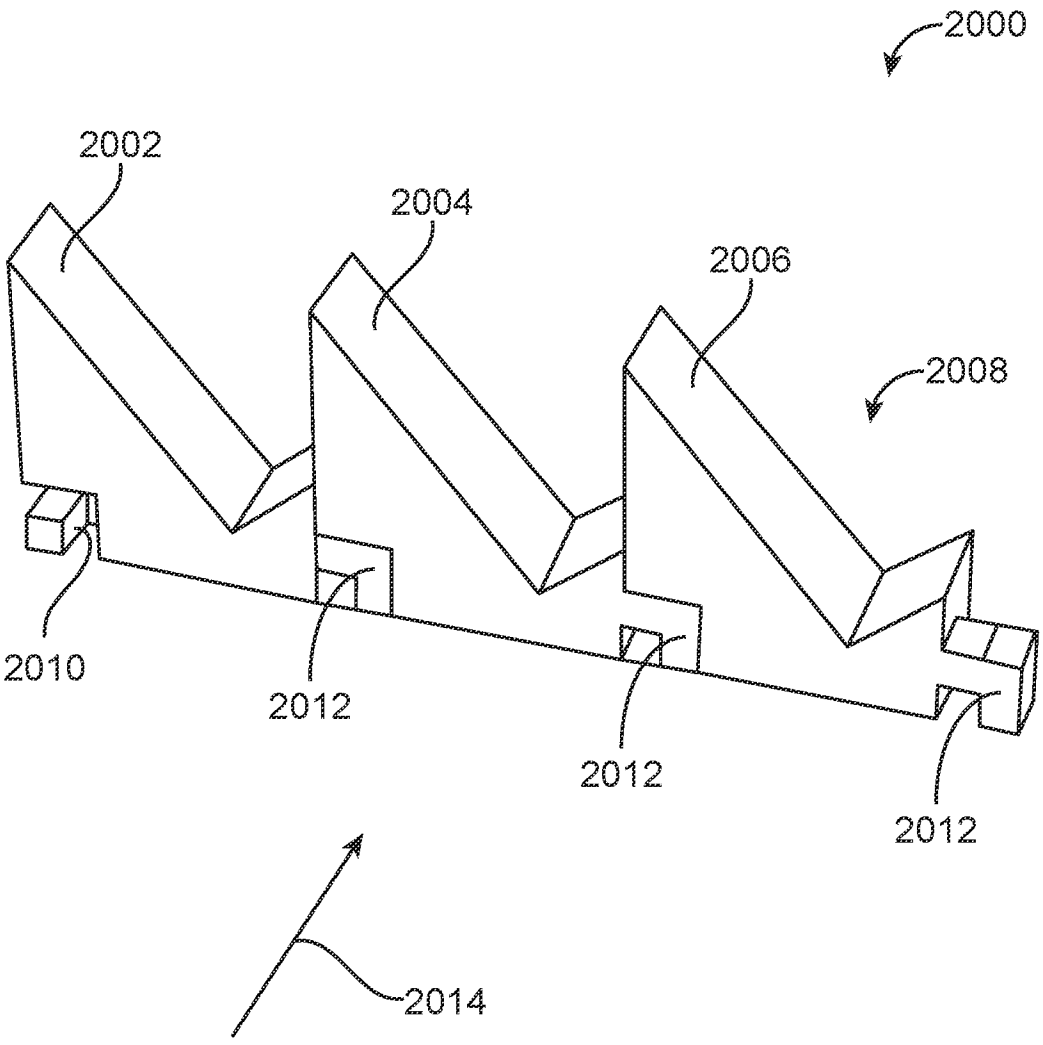
FIG. 20 depicts a perspective view of alternate bases connected together via a sliding action.

FIG. 20 depicts a perspective view of alternate bases connected together 2000 via a sliding action 2014. In this embodiment, base pans 2002, 2004, 2006 are connected with hooked protrusion shape 2012 that corresponds to a hooked receiver shape 2010 so that each base pan 2002, 2004, 2006 piece needs to slide in front of another base pan 2002, 2004, 2006 piece to connect the base pans. Cosmetic containers may be placed diagonally into the empty space 2008 on top of the base pans 2002, 2004, 2006.

FIGS. 21A-21H depict alternate base pans 2100, 2102, 2104, 2106, 2108, 2110, 2112, 2114 connected to one another by side magnets. The shapes of these base pans 2100, 2102, 2104, 2106, 2108, 2110, 2112, 2114 may be varied to create a repeating pattern.

Figure 22:
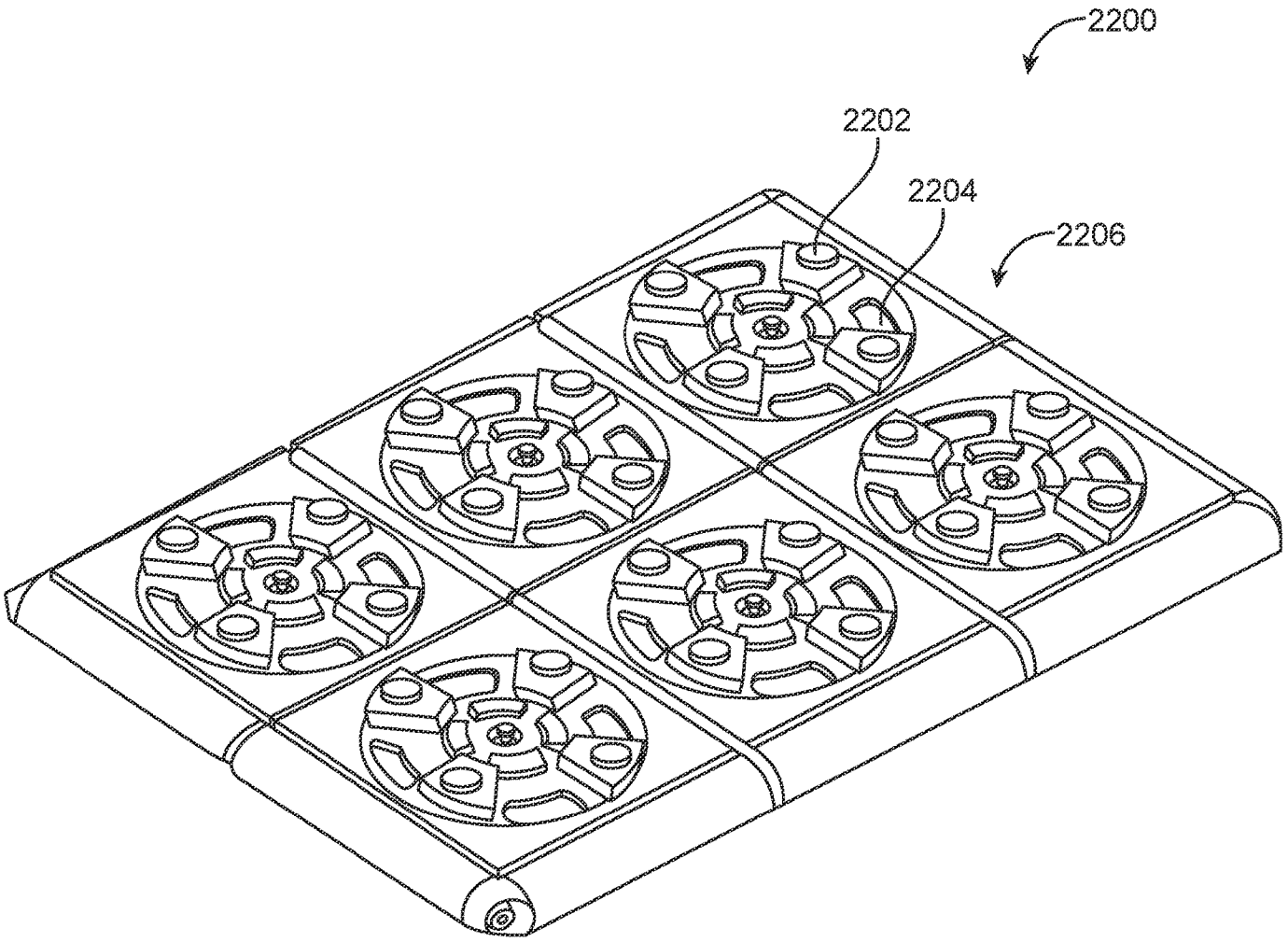
FIG. 22 depicts an alternate base pan having both indented and protruding shapes.

FIG. 22 depicts an alternate base pan 2200 having both indented 2204 and protruding 2202 shapes. The base pan 2200 is shown as having six connections 2206. The number of connections 2206 may be varied in other embodiments. Each connection 2206 may have one or more indented shapes 2204 and one or more protruding shapes 2202. The one or more indented shapes 2204 and one or more protruding shapes 2202 may correspond to one or more indented shapes and one or more protruding shapes on one or more cosmetic containers that may be detachably attached to the base pan 2200. In some embodiments, the one or more indented shapes 2204 and one or more protruding shapes 2202 may allow the base pan 2200 to receive cosmetic containers having differing corresponding shapes for connection. For example, in one embodiment, a first cosmetic container may only connect with the one or more indented shapes 2204 while a second cosmetic container may only connect with the one or more protruding shapes 2202. In some embodiments, the one or more indented shapes 2004 may extend through an entire width of the base pan 2200 and form an opening or aperture. The base pan 200 may include one or more magnets for connecting to one or more corresponding magnets in one or more cosmetic containers.

It is contemplated that various combinations and/or subcombinations of the specific features and aspects of the above embodiments may be made and still fall within the scope of the invention. Accordingly, it should be understood that various features and aspects of the disclosed embodiments may be combined with or substituted for one another in order to form varying modes of the disclosed invention. Further, it is intended that the scope of the present invention is herein disclosed by way of examples and should not be limited by the particular disclosed embodiments described above.

What is claimed is:

1. A system comprising:

a base pan comprising two or more base pan male protrusions and one or more base pan magnets;

a cosmetic container comprising a cosmetic container female indentation, wherein the cosmetic container female indentation is configured to receive a base pan male protrusion of the two or more base pan male protrusions such that the cosmetic container is configured to be detachably attached to the base pan, wherein the cosmetic container further comprises:

a bottle, wherein the cosmetic container female indentation is disposed on a bottom of the bottle;

at least one female indentation magnet disposed in the cosmetic container female indentation, wherein the at least one female indentation magnet in the cosmetic container female indentation is configured to attract the one or more base pan magnets in the base pan to secure the cosmetic container to the base pan;

a cap, wherein the cap is a separate component from the bottle, and wherein the cap is detachably attached to the bottle;

a top cap attached to the cap such that the top cap forms a top cap male protrusion, wherein the top cap is a separate component from the cap; and a cap magnet disposed between the cap and the top cap;

a collar attached to a top portion of the bottle, wherein the collar is a separate component from the bottle, and wherein the top portion of the bottle is disposed distal from the cosmetic container female indentation.

2. The system of claim 1, wherein the base pan further comprises:

a base.

3. The system of claim 2, wherein the base pan further comprises:

a cover comprising the two or more base pan male protrusions, wherein the cover fits over the base.

4. The system of claim 3, wherein the one or more base pan magnets are disposed between the cover and the base.

5. The system of claim 1, wherein the cosmetic container further comprises:

a plug disposed in an opening of the collar.

6. The system of claim 5, wherein the cosmetic container further comprises:

an inner cap secured to the collar; and an applicator connected to the inner cap.

* * * * *